US009220947B2

(12) United States Patent
Kim et al.

(10) Patent No.: US 9,220,947 B2
(45) Date of Patent: Dec. 29, 2015

(54) PROCESS FOR DESIGNING DIMPLE PATTERN OF GOLF BALL

(75) Inventors: Hyoungchol Kim, Kobe (JP); Masahide Onuki, Kobe (JP)

(73) Assignee: DUNLOP SPORTS CO. LTD, Kobe-Shi (JP)

( * ) Notice: Subject to any disclaimer, the term of this patent is extended or adjusted under 35 U.S.C. 154(b) by 452 days.

(21) Appl. No.: 13/611,027

(22) Filed: Sep. 12, 2012

(65) Prior Publication Data

US 2013/0095957 A1 Apr. 18, 2013

(30) Foreign Application Priority Data

Oct. 18, 2011 (JP) ..... 2011-228414

(51) Int. Cl.
*A63B 37/14* (2006.01)
*A63B 37/00* (2006.01)

(52) U.S. Cl.
CPC ..... *A63B 37/006* (2013.01); *A63B 37/0051* (2013.01); *A63B 37/008* (2013.01); *A63B 37/0083* (2013.01); *Y10T 29/49771* (2015.01)

(58) Field of Classification Search
USPC ..... 473/378–385
See application file for complete search history.

(56) References Cited

U.S. PATENT DOCUMENTS

| | | | |
|---|---|---|---|
| 4,729,861 | A | 3/1988 | Lynch et al. |
| 4,744,564 | A | 5/1988 | Yamada |
| 4,936,587 | A | 6/1990 | Lynch et al. |
| 5,080,367 | A | 1/1992 | Lynch et al. |
| 5,688,194 | A | 11/1997 | Stiefel et al. |
| 5,772,532 | A | 6/1998 | Stiefel et al. |
| 6,254,496 | B1 | 7/2001 | Maehara et al. |
| 2010/0234141 | A1 | 9/2010 | Kim et al. |

FOREIGN PATENT DOCUMENTS

JP 2010088640 A * 4/2010

* cited by examiner

*Primary Examiner* — Alvin Hunter
(74) *Attorney, Agent, or Firm* — Birch, Stewart, Kolasch & Birch, LLP

(57) ABSTRACT

A golf ball 2 has, on a surface thereof, a dimple pattern consisting of a land 10 and a large number of dimples 8. A process for designing the dimple pattern includes the steps of:

(1) randomly arranging a large number of points on the surface of a phantom sphere;
(2) calculating a distance between a first point and a second point which is a point closest to the first point;
(3) deciding a radius on the basis of the distance;
(4) assuming a circle which has a center at the first point and has the radius; and
(5) assuming a dimple whose contour coincides with the circle.

The dimples 8 are randomly arranged.

1 Claim, 32 Drawing Sheets

PROCESS FOR DESIGNING DIMPLE PATTERN OF GOLF BALL

This application claims priority on Patent Application No. 2011-228414 filed in JAPAN on Oct. 18, 2011. The entire contents of this Japanese Patent Application are hereby incorporated by reference.

BACKGROUND OF THE INVENTION

1. Field of the Invention

The present invention relates to golf balls. Specifically, the present invention relates to processes for designing dimple patterns of golf balls.

2. Description of the Related Art

Golf balls have a large number of dimples on the surface thereof. The dimples disturb the air flow around the golf ball during flight to cause turbulent flow separation. By causing the turbulent flow separation, separation points of the air from the golf ball shift backwards leading to a reduction of drag. The turbulent flow separation promotes the displacement between the separation point on the upper side and the separation point on the lower side of the golf ball, which results from the backspin, thereby enhancing the lift force that acts upon the golf ball. The reduction of drag and the enhancement of lift force are referred to as a "dimple effect".

The United States Golf Association (USGA) has established the rules about symmetry of golf balls. According to the rules, the trajectory during PH (pole horizontal) rotation and the trajectory during POP (pole over pole) rotation are compared with each other. A golf ball having a large difference between these two trajectories does not conform to the rules. In other words, a golf ball having inferior aerodynamic symmetry does not conform to the rules. A golf ball with inferior aerodynamic symmetry has a short flight distance because the aerodynamic characteristic of the golf ball for PH rotation or for POP rotation is inferior. The rotation axis for PH rotation extends through the poles of the golf ball, and the rotation axis for POP rotation is orthogonal to the rotation axis for PH rotation.

The dimples can be arranged by using a regular polyhedron that is inscribed in the phantom sphere of a golf ball. In this arrangement method, the surface of the phantom sphere is divided into a plurality of units by division lines obtained by projecting the sides of the polyhedron on the spherical surface. The dimple pattern of one unit is developed all over the phantom sphere. According to this dimple pattern, the aerodynamic characteristic in the case where a line passing through a vertex of the regular polyhedron is a rotation axis is different from that in the case where a line passing through the center of a surface of the regular polyhedron is a rotation axis. Such a golf ball has inferior aerodynamic symmetry.

JP50-8630 (U.S. Pat. No. 4,729,861, U.S. Pat. No. 4,936,587, and U.S. Pat. No. 5,080,367) discloses a golf ball having an improved dimple pattern. The surface of the golf ball is divided by an icosahedron that is inscribed in the phantom sphere thereof. On the basis of this division, dimples are arranged on the surface of the golf ball. According to this dimple pattern, the number of great circles that do not intersect any dimples is 1. This great circle coincides with the equator of the golf ball. The region near the equator is a unique region.

Generally, a golf ball is formed by a mold including upper and lower mold halves. The mold has a parting line. A golf ball obtained by this mold has a seam at a position along the parting line. Through this forming, spew occurs along the seam. The spew is removed by means of cutting. By cutting the spew, the dimples near the seam are deformed. In addition, the dimples near the seam tend to be orderly arranged. The seam is located along the equator of the golf ball. The region near the equator is a unique region.

A mold having an uneven parting line has been used. A golf ball obtained by this mold has dimples on the equator thereof. The dimples on the equator contribute to eliminating the uniqueness of the region near the equator. However, the uniqueness is not sufficiently eliminated. This golf ball has insufficient aerodynamic symmetry.

JP61-284264 (U.S. Pat. No. 4,744,564) discloses a golf ball in which the dimples near the seam are greater in volume than the dimples near the poles. This volume difference contributes to eliminating the uniqueness of the region near the equator. This golf ball eliminates, by the volume difference of dimples, the disadvantage caused by the dimple pattern. The disadvantage caused by the dimple pattern is eliminated not by modification of the dimple pattern. In the golf ball, the potential of the dimple pattern is sacrificed. The flight distance of the golf ball is insufficient.

JP9-164223 (U.S. Pat. No. 5,688,194 and U.S. Pat. No. 5,772,532) discloses a golf ball in which a large number of dimples are randomly arranged. The random arrangement enhances aerodynamic symmetry. JP2000-189542 also discloses a golf ball in which a large number of dimples are randomly arranged.

JP2010-213741 (US2010/0234141) discloses a golf ball having a rugged pattern obtained by a Cellular Automaton method. In the rugged pattern, dimples are randomly arranged.

In a method disclosed in JP9-164223, a process of trial and error is conducted in order to obtain a desired dimple pattern. In a method disclosed in JP2000-189542 as well, a process of trial and error is conducted in order to obtain a desired dimple pattern.

In the golf ball disclosed in JP2010-213741, the dimples are non-circular. The dimple effect of the dimples is insufficient.

An object of the present invention is to provide a golf ball having circular dimples and excellent aerodynamic symmetry.

SUMMARY OF THE INVENTION

A process for designing a dimple pattern of a golf ball according to the present invention comprises the steps of:

(1) randomly arranging a large number of points on a surface of a phantom sphere;

(2) calculating a distance between a first point and a second point which is a point closest to the first point;

(3) deciding a radius on the basis of the distance;

(4) assuming a circle which has a center at the first point and has the radius; and (5) assuming a dimple whose contour coincides with the circle.

Preferably, at the step (3), half of the distance is set as the radius.

Preferably, at the step (1), the large number of points are randomly arranged on the basis of a Cellular Automaton method. Preferably, at the step (1), the large number of points are randomly arranged on the basis of a reaction-diffusion model of the Cellular Automaton method.

Preferably, the step (1) comprises the steps of:

(1.1) assuming a plurality of states;

(1.2) assuming a large number of cells on the surface of the phantom sphere;

(1.3) assigning any one of the states to each cell;

(1.4) assigning, as an attribute of said each cell, any one of INSIDE, OUTSIDE, and BOUNDARY to said each cell on the basis of the state of said each cell and states of a plurality of cells located adjacent to said each cell;

(1.5) assuming a loop by connecting cells of BOUNDARY; and (1.6) deciding a point on the basis of the loop or another loop obtained on the basis of this loop.

A golf ball according to the present invention has a large number of dimples on a surface thereof. These dimples are randomly arranged. A pattern of these dimples is designed by the process described above.

Preferably, in the golf ball, a fluctuation range Rh and a fluctuation range Ro are equal to or less than 3.3 mm and are obtained by the steps of:

(1) assuming a line which connects both poles of the golf ball, as a first rotation axis;

(2) assuming a great circle which exists on a surface of a phantom sphere of the golf ball and is orthogonal to the first rotation axis;

(3) assuming two small circles which exist on the surface of the phantom sphere of the golf ball, which are orthogonal to the first rotation axis, and of which an absolute value of a central angle with the great circle is 30°;

(4) defining a region, of the surface of the golf ball, which is obtained by dividing the golf ball at the two small circles and which is sandwiched between the two small circles;

(5) determining 30240 points on the region at intervals of a central angle of 3° in a direction of the first rotation axis and at intervals of a central angle of 0.25° in a direction of rotation about the first rotation axis;

(6) calculating a length L1 of a perpendicular line which extends from each point to the first rotation axis;

(7) calculating a total length L2 by summing twenty-one lengths L1 calculated on the basis of twenty-one perpendicular lines arranged in the direction of the first rotation axis;

(8) determining a maximum value and a minimum value among 1440 total lengths L2 calculated along the direction of rotation about the first rotation axis, and calculating a fluctuation range Rh by subtracting the minimum value from the maximum value;

(9) assuming a second rotation axis orthogonal to the first rotation axis assumed at the step (1);

(10) assuming a great circle which exists on the surface of the phantom sphere of the golf ball and is orthogonal to the second rotation axis;

(11) assuming two small circles which exist on the surface of the phantom sphere of the golf ball, which are orthogonal to the second rotation axis, and of which an absolute value of a central angle with the great circle is 30°;

(12) defining a region, of the surface of the golf ball, which is obtained by dividing the golf ball at the two small circles and which is sandwiched between the two small circles;

(13) determining 30240 points on the region at intervals of a central angle of 3° in a direction of the second rotation axis and at intervals of a central angle of 0.25° in a direction of rotation about the second rotation axis;

(14) calculating a length L1 of a perpendicular line which extends from each point to the second rotation axis;

(15) calculating a total length L2 by summing twenty-one lengths L1 calculated on the basis of twenty-one perpendicular lines arranged in the direction of the second rotation axis; and (16) determining a maximum value and a minimum value among 1440 total lengths L2 calculated along the direction of rotation about the second rotation axis, and calculating a fluctuation range Ro by subtracting the minimum value from the maximum value.

Preferably, an absolute value of a difference dR between the fluctuation range Rh and the fluctuation range Ro is equal to or less than 1.0 mm.

DESCRIPTION OF THE PREFERRED EMBODIMENTS

The following will describe in detail the present invention on the basis of preferred embodiments with reference to the accompanying drawings.

Figure 1:
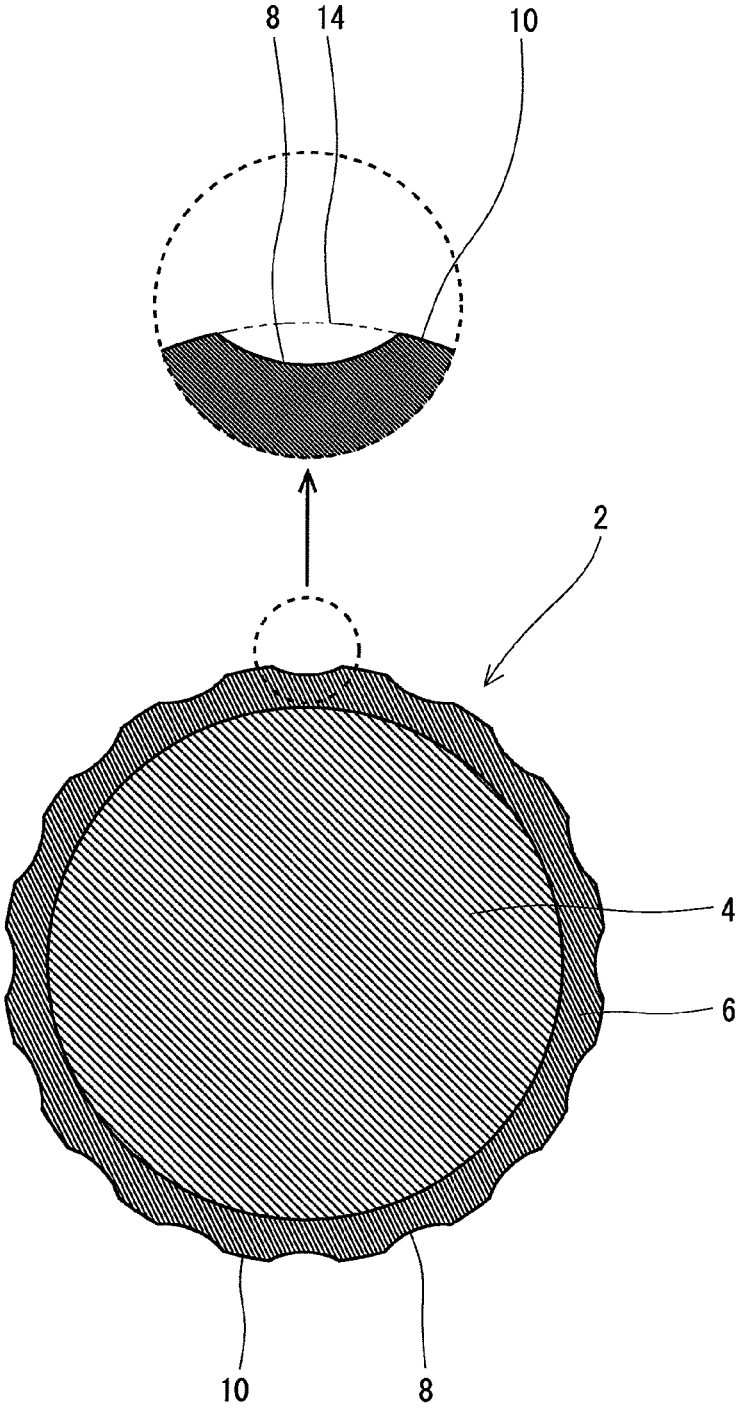
FIG. 1 is a schematic cross-sectional view of a golf ball according to one embodiment of the present invention.

A golf ball 2 shown in FIG. 1 includes a spherical core 4 and a cover 6. On the surface of the cover 6, a large number of dimples 8 are formed. Of the surface of the golf ball 2, a part other than the dimples 8 is a land 10. The golf ball 2 includes a paint layer and a mark layer on the external side of the cover 6 although these layers are not shown in the drawing. A mid layer may be provided between the core 4 and the cover 6.

The golf ball 2 preferably has a diameter of 40 mm or greater but 45 mm or less. From the standpoint of conformity to the rules established by the United States Golf Association (USGA), the diameter is particularly preferably equal to or greater than 42.67 mm. In light of suppression of air resistance, the diameter is more preferably equal to or less than 44 mm and particularly preferably equal to or less than 42.80 mm. The golf ball 2 preferably has a weight of 40 g or greater but 50 g or less. In light of attainment of great inertia, the weight is more preferably equal to or greater than 44 g and particularly preferably equal to or greater than 45.00 g. From the standpoint of conformity to the rules established by the USGA, the weight is particularly preferably equal to or less than 45.93 g.

The core 4 is formed by crosslinking a rubber composition. Examples of base rubbers for use in the rubber composition include polybutadienes, polyisoprenes, styrene-butadiene copolymers, ethylene-propylene-diene copolymers, and natural rubbers. Two or more rubbers may be used in combination. In light of resilience performance, polybutadienes are preferred, and, high-cis polybutadienes are particularly preferred.

In order to crosslink the core 4, a co-crosslinking agent can be used. Examples of preferable co-crosslinking agents in light of resilience performance include zinc acrylate, magnesium acrylate, zinc methacrylate, and magnesium methacrylate. Preferably, the rubber composition includes an organic peroxide together with a co-crosslinking agent. Examples of suitable organic peroxides include dicumyl peroxide, 1,1-bis (t-butylperoxy)-3,3,5-trimethylcyclohexane, 2,5-dimethyl-2, 5-di(t-butylperoxy)hexane, and di-t-butyl peroxide.

According to need, various additives such as sulfur, a sulfur compound, a filler, an anti-aging agent, a coloring agent, a plasticizer, a dispersant, and the like are included in the rubber composition of the core 4 in an adequate amount. Crosslinked rubber powder or synthetic resin powder may also be included in the rubber composition.

The core 4 has a diameter of 30.0 mm or greater and particularly 38.0 mm or greater. The diameter of the core 4 is equal to or less than 42.0 mm and particularly equal to or less than 41.5 mm. The core 4 may be composed of two or more layers. The core 4 may have a rib on its surface.

A suitable polymer for the cover 6 is an ionomer resin. Examples of preferable ionomer resins include binary copolymers formed with an α-olefin and an α,β-unsaturated carboxylic acid having 3 to 8 carbon atoms. Examples of other preferable ionomer resins include ternary copolymers formed with: an α-olefin; an α,α-unsaturated carboxylic acid having 3 to 8 carbon atoms; and an α,β-unsaturated carboxylate ester having 2 to 22 carbon atoms.

For the binary copolymers and ternary copolymers, preferable α-olefins are ethylene and propylene, while preferable α,β-unsaturated carboxylic acids are acrylic acid and methacrylic acid. In the binary copolymers and ternary copolymers, some of the carboxyl groups are neutralized with metal ions. Examples of metal ions for use in neutralization include sodium ion, potassium ion, lithium ion, zinc ion, calcium ion, magnesium ion, aluminum ion, and neodymium ion.

Another polymer may be used instead of or together with an ionomer resin. Examples of the other polymer include thermoplastic polyurethane elastomers, thermoplastic styrene elastomers, thermoplastic polyamide elastomers, thermoplastic polyester elastomers, and thermoplastic polyolefin elastomers. In light of spin performance, thermoplastic polyurethane elastomers are preferred.

According to need, a coloring agent such as titanium dioxide, a filler such as barium sulfate, a dispersant, an antioxidant, an ultraviolet absorber, a light stabilizer, a fluorescent material, a fluorescent brightener, and the like are included in the cover 6 in an adequate amount. For the purpose of adjusting specific gravity, powder of a metal with a high specific gravity such as tungsten, molybdenum, and the like may be included in the cover 6.

The cover 6 has a thickness of 0.1 mm or greater and particularly 0.3 mm or greater. The thickness of the cover 6 is equal to or less than 2.5 mm and particularly equal to or less than 2.2 mm. The cover 6 has a specific gravity of 0.90 or greater and particularly 0.95 or greater. The specific gravity of the cover 6 is equal to or less than 1.10 and particularly equal to or less than 1.05. The cover 6 may be composed of two or more layers.

Figure 2:
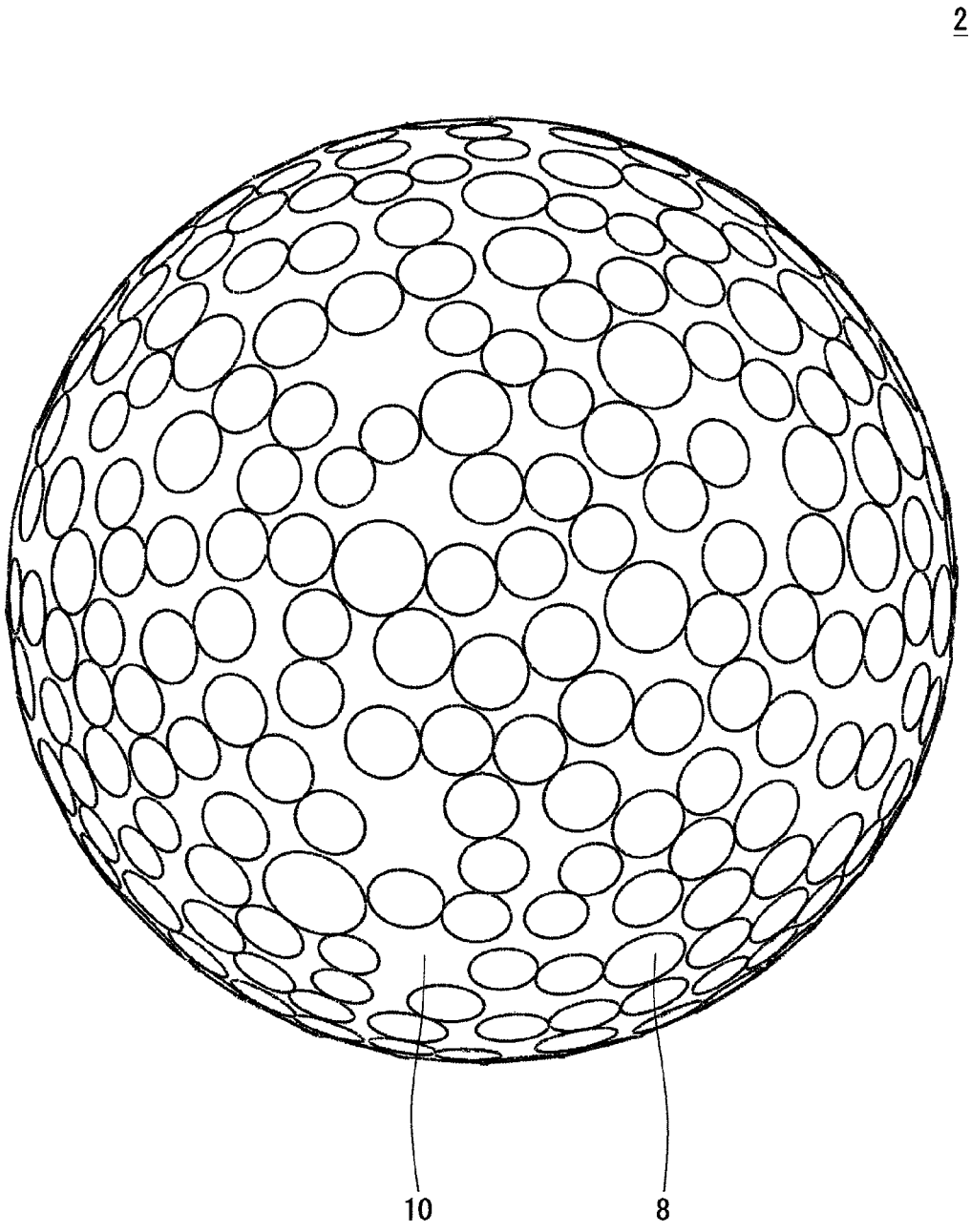
FIG. 2 is an enlarged front view of the golf ball in FIG. 1.
Figure 3:
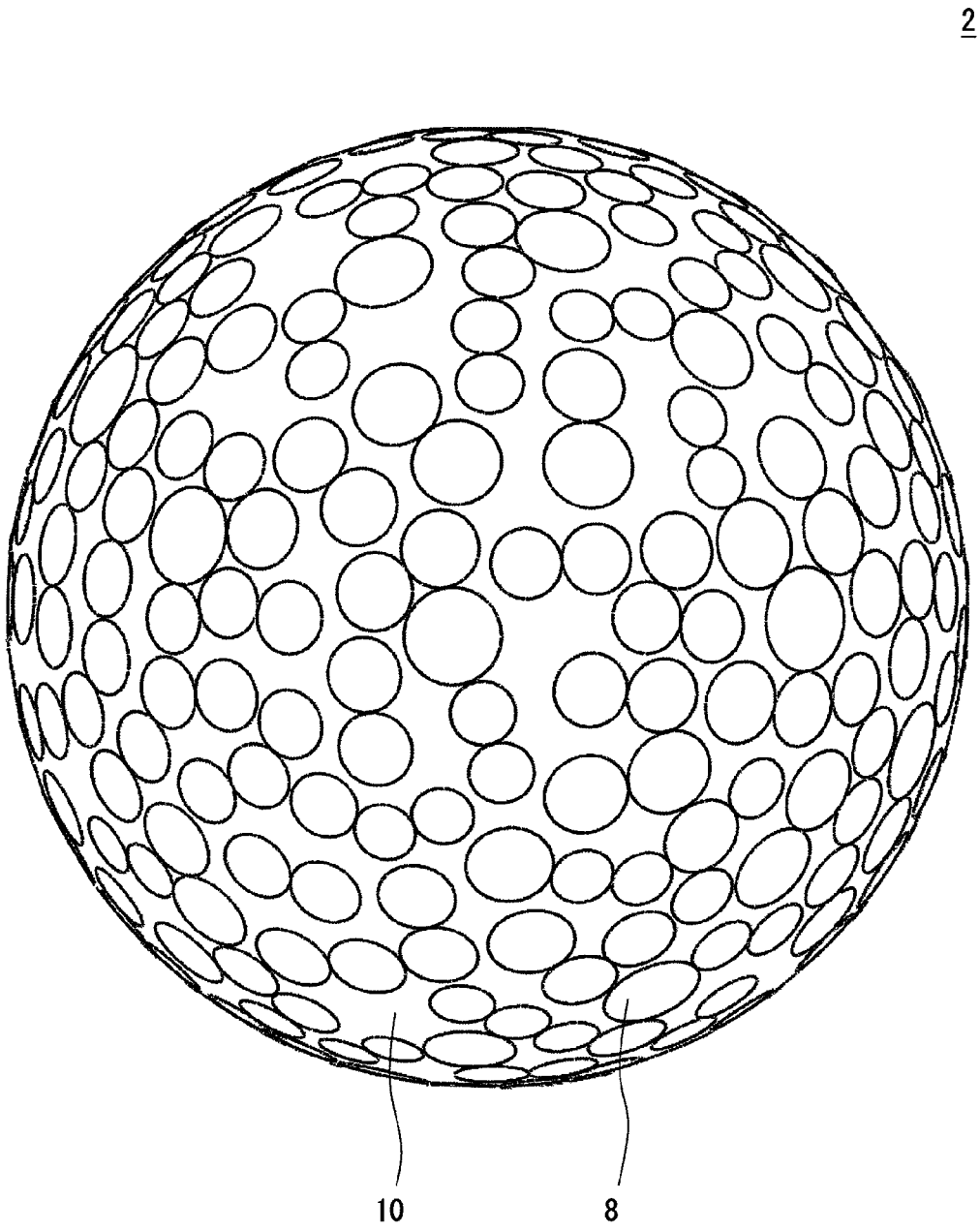
FIG. 3 is a plan view of the golf ball in FIG. 2.

FIG. 2 is an enlarged front view of the golf ball 2. FIG. 3 is a plan view of the golf ball 2 in FIG. 2. As is obvious from FIGS. 2 and 3, the golf ball 2 has a large number of the dimples 8. The contour of each dimple 8 is circular. By these dimples 8 and the land 10, a dimple pattern is formed on the surface of the golf ball 2.

In the dimple pattern, a large number of dimples are randomly arranged. In a process for designing the dimple pattern, a large number of points are randomly arranged on the surface of a phantom sphere 14 of the golf ball. Circles having centers at the points, respectively, are assumed. Dimples whose contours coincide with the circles, respectively, are assumed. Since the arrangement of the points is random, the arrangement of the dimples is also random. The designing process is preferably executed using a computer and software in light of efficiency. Of course, the present invention is practicable even by hand calculation. The essence of the present invention is not in a computer and software.

Preferably, a Cellular Automaton method is used for arranging the points. By the Cellular Automaton method, a pattern in which a large number of loops are randomly arranged on the surface of the phantom sphere 14 is obtained. The central points of these loops are obtained. Since the arrangement of the loops is random, the arrangement of the central points is also random.

The Cellular Automaton method is widely used in the fields of computability theory, mathematics, theoretical biology, and the like. A model of the Cellular Automaton method consists of a large number of cells and simple rules. By this model, natural phenomena such as life phenomena, crystal growth, turbulent flow, and the like can be simulated. In this model, each cell has a state. This state can change to another state as a stage proceeds. The state of a cell at stage (t+1) is decided by the state of this cell and the states of a plurality of cells adjacent to this cell at stage (t). This decision is performed according to a rule. This rule is equally applied to all the cells.

For designing the dimple pattern, a reaction-diffusion model of the Cellular Automaton method is suitable. This model is used for simulating patterns on body surfaces of beasts, birds, fish, insects, and the like. In this model, a plurality of states are assumed. The number of states is normally equal to or greater than 2 but equal to or less than 8. For each cell, an initial state is decided. As a stage proceeds, the state is updated according to a rule. There are cells whose states change by this update, while there are also cells whose states do not change by this update. The Cellular Automaton method is disclosed at Pages 25 to 28 of "Seru Otomaton Hou, Fukuzatsukei No Jikososhikika To Chouheiretsushori (Cellular Automaton method, Self-organization of Complex Systems and Massively Parallel Processing)" (written by Yasuyoshi Kato et al, published by Morikita Publishing Co., Ltd.).

A designing process according to the present invention is characterized in that the state of a cell is updated under the influence of other cells adjacent to this cell. By this update, a pattern in which a large number of loops are randomly arranged is obtained. As long as this characteristic is maintained, any model can be used. The following will describe in detail a designing process using a reaction-diffusion model of the Cellular Automaton method.

Figure 4:
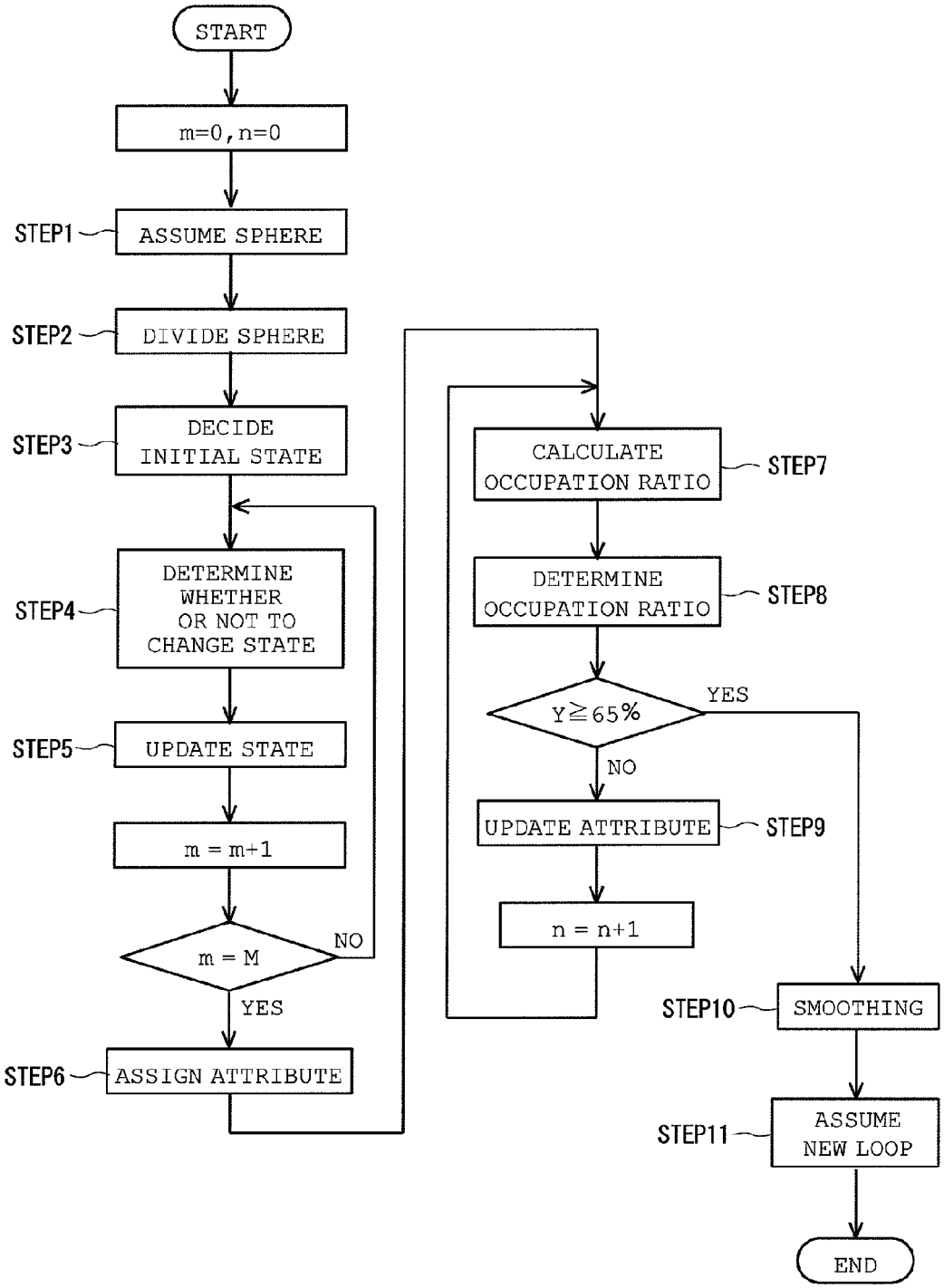
FIG. 4 is a flowchart of a process for designing a pattern of loops.
Figure 5:
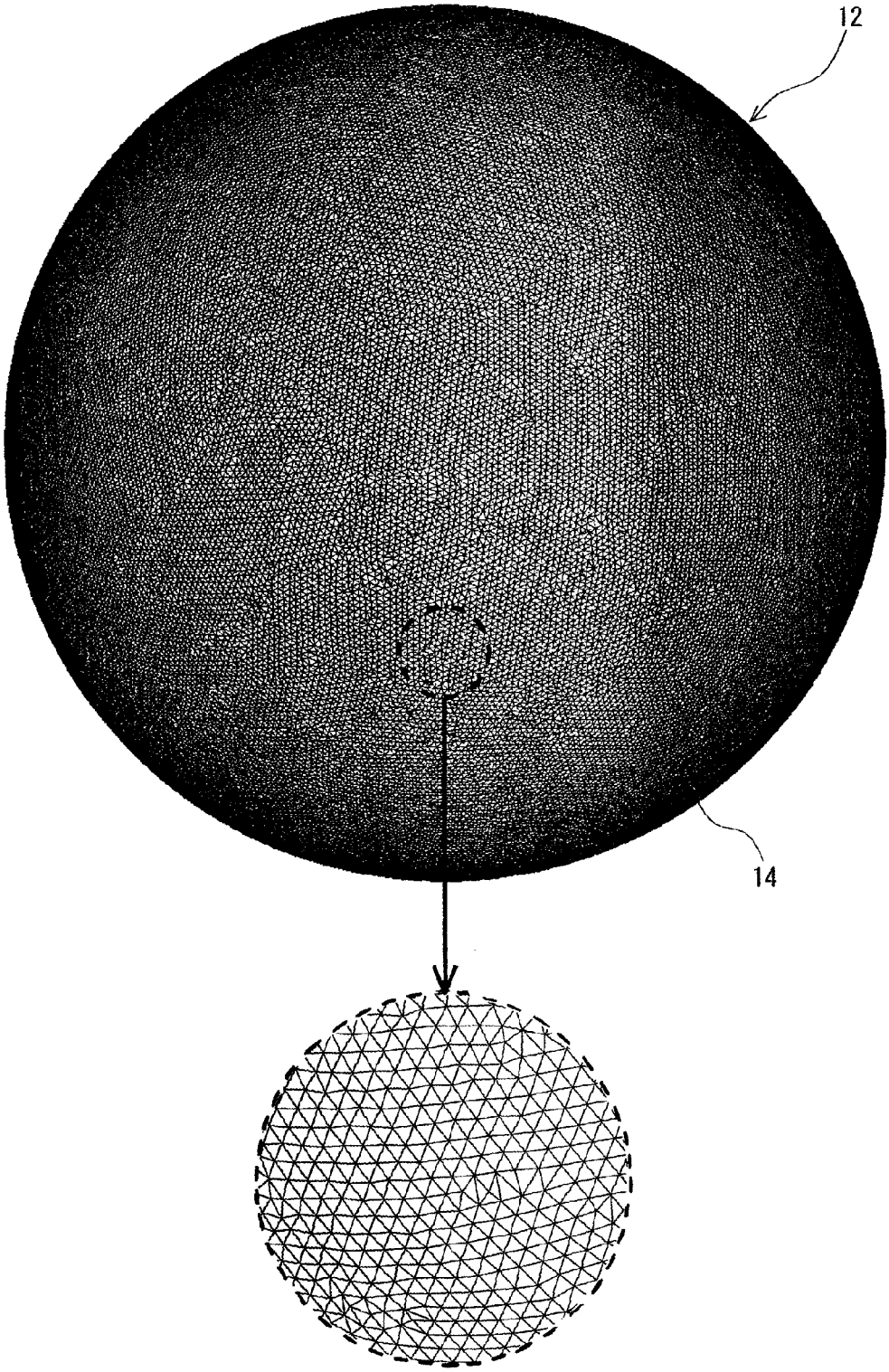
FIG. 5 is a front view of a mesh used in the designing process in FIG. 4.

FIG. 4 is a flowchart of a process for designing a pattern of loops. FIG. 5 is a front view of a mesh 12 used in the designing process in FIG. 4. For forming the mesh 12, a sphere 14 is assumed (STEP 1). The diameter of the phantom sphere 14 is the same as that of the golf ball 2. The surface of the phantom sphere 14 is divided into a large number of triangles (STEP 2). This division is performed on the basis of an advancing front method. The advancing front method is disclosed at Pages 195 to 197 of "Daigakuin Jouhoushori Kogaku 3 Keisanrikigaku (Information Science and Technology 3 of Graduate School, Computational Dynamics)" (edited by Kouichi ITO, published by Kodansha Ltd.). The mesh 12 has 176528 triangles and 88266 vertices. Each vertex is defined as a cell (or the center of a cell). The mesh 12 has 88266 cells. The phantom sphere 14 may be divided by other methods.

In the designing process, two states, a differentiated state and an undifferentiated state, are assumed. For each cell, either state (an initial state) is decided (STEP 3). The decision is preferably performed in a random manner. For the random decision, random numbers and a residue system are used. Because the number of states is 2, a residue system having a base of 2 is used. Specifically, a random number to 5 decimal places, which is equal to or greater than 0 and less than 1, is generated by a computer. The random number is multiplied by 100000, and the product is divided by 2. The remainder for the division is "1" or "0". On the basis of the remainder, the state of the cell is decided. For example, when the remainder is "1", the differentiated state is selected, and when the remainder is "0", the undifferentiated state is selected. For all the cells, this decision is performed. The mesh 12 after the decision is at stage 1.

Figure 6:
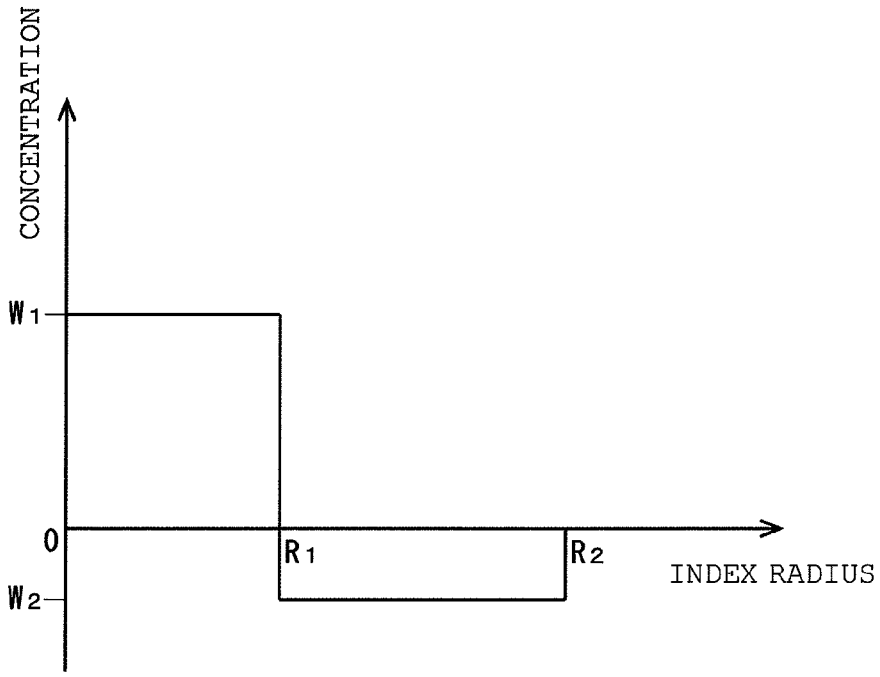
FIG. 6 is a graph for explaining a rule for the designing process in FIG. 4.

For each cell, whether or not to change the state is determined (STEP 4). This determination is performed according to a rule. FIG. 6 is a graph for explaining the rule. In the graph, the vertical axis indicates a concentration, and the horizontal axis indicates an index radius. The index radius is a value obtained by dividing a distance from the cell by a reference value. The reference value is the distance between the cell and a cell closest to the cell. A first concentration $W_1$ is positive, and a second concentration $W_2$ is negative. The absolute value of the first concentration $W_1$ is greater than the absolute value of the second concentration $W_2$. An index radius $R_2$ is greater than an index radius $R_1$. In the area where the index radius is greater than 0 and equal to or less than $R_1$, the concentration is $W_1$. In the area where the index radius is greater than $R_1$ and equal to or less than $R_2$, the concentration is $W_2$.

Figure 7:
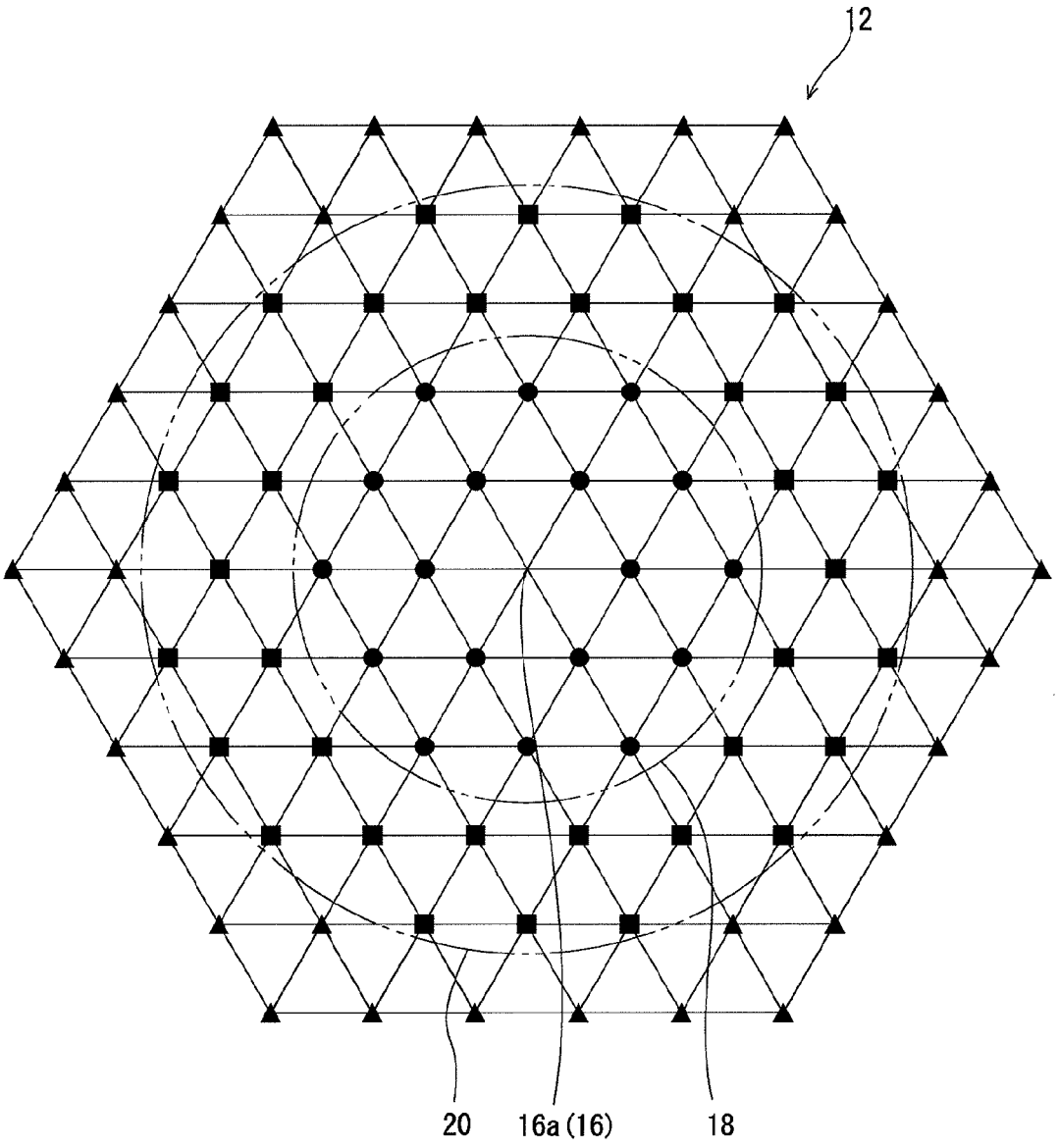
FIG. 7 is a partially enlarged view of the mesh in FIG. 5.

FIG. 7 is a partially enlarged view of the mesh 12 in FIG. 5. For convenience's sake, in FIG. 7, the mesh 12 is two-dimensionally drawn. At the center in FIG. 7, a cell 16*a*, which is an object for which the determination is performed, is shown. Furthermore, in FIG. 7, a first circle 18 and a second circle 20 are shown. The first circle 18 has a center at the cell 16*a* and an index radius of $R_1$. The second circle 20 has a center at the cell 16*a* and an index radius of $R_2$. What are indicated by filled circles are cells 16 included in the first circle 18 other than the cell 16*a*. What are indicated by filled squares are cells 16 that are included in the second circle 20 and not included in the first circle 18. What are indicated by filled triangles are cells 16 that are not included in the second circle 20.

In the designing process, the number $N_{R1}$ of cells 16 in a specific state which are included in the first circle 18 and not located at the center of the first circle 18, is counted. In a preferred embodiment, the number of cells 16 whose states are differentiated is counted to obtain the total number $N_{R1}$. Furthermore, in the designing process, the number $N_{R1-R2}$ of cells 16 in a specific state which are included in the second circle 20 and not included in the first circle 18, is counted. In a preferred embodiment, the number of cells 16 whose states are differentiated is counted to obtain the total number $N_{R1-R2}$. The numbers $N_{R1}$ and $N_{R1-R2}$ are substituted into the following mathematical formula (1) to obtain a value E. On the basis of the value E, whether or not to change the state of the cell 16*a* is determined.

$$E=W_1*N_{R1}+W_2*N_{R1-R2} \quad (1)$$

On the basis of the determination, the state of the cell 16*a* is updated (STEP 5). In the update, the state of the cell 16*a* may change or may not change. In a preferred embodiment, when the value E is positive, the state of the cell 16*a* is maintained if the state of the cell 16*a* is differentiated, and the state of the cell 16*a* is changed to be differentiated if the state of the cell 16*a* is undifferentiated. When the value E is zero, the state of the cell 16*a* is maintained. When the value E is negative, the state of the cell 16*a* is changed to be undifferentiated if the state of the cell 16*a* is differentiated, and the state of the cell 16*a* is maintained if the state of the cell 16*a* is undifferentiated. The mesh 12 in which the update for the first time is completed for all the cells 16 is at stage 2.

The following will describe a calculation example for the determination and the update.

Conditions

First concentration $W_1$: 1.00

Second concentration $W_2$: −0.60

Number of cells which are included in the first circle and whose states are differentiated (except for the cell 16*a*): 8

Number of cells which are included in the second circle and not included in the first circle and whose states are differentiated: 13

Calculation Example $$E = 1.00*8 - 0.60*13$$
$$= 0.2$$

In this case, because the value E is positive, the state of the cell 16*a* is maintained if the state of the cell 16*a* is differentiated, and the state of the cell 16*a* is changed to be differentiated if the state of the cell 16*a* is undifferentiated.

The following will describe another calculation example for the determination and the update.

Conditions

First concentration $W_1$: 1.00

Second concentration $W_2$: −0.60

Number of cells which are included in the first circle and whose states are differentiated (except for the cell 16*a*): 5

Number of cells 16 which are included in the second circle and not included in the first circle and whose states are differentiated: 9

Calculation Example $$E = 1.00 * 5 - 0.60 * 9$$
$$= -0.4$$

In this case, because the value E is negative, the state of the cell 16*a* is changed to be undifferentiated if the state of the cell 16*a* is differentiated, and the state of the cell 16*a* is maintained if the state of the cell 16*a* is undifferentiated.

The determination and the update are repeated. The number of times of the repetition is M in the flowchart in FIG. 4. The mesh 12 after the repetition of M times is completed is at stage (M+1). As a stage proceeds, the number of cells 16 whose states change by update decreases. At a stage with a small number of times of the repetition, the change in pattern by update is great. By update being performed a large number of times, the pattern converges. The number of times of the repetition is preferably equal to or greater than 3 and more preferably equal to or greater than 5. If the number of times of the repetition is excessive, a load on the computer is great. In this respect, the number of times of the repetition is preferably equal to or less than 30 and more preferably equal to or less than 10.

Figure 8:
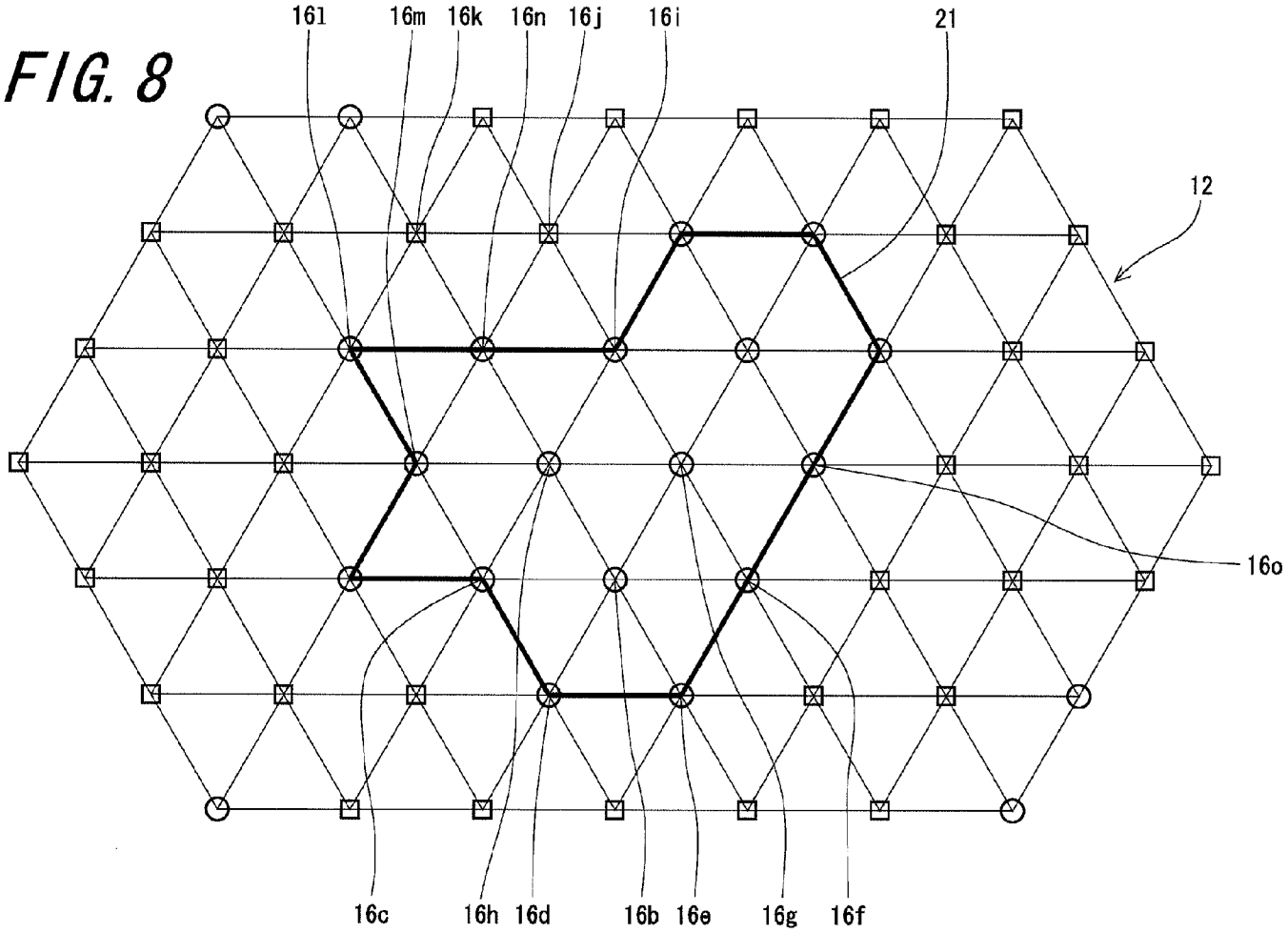
FIG. 8 is a partially enlarged view of the mesh after update is completed.

The determination and the update are repeated M times to fix the state of each cell 16. This fixing is "to assign a state" to the cell 16. FIG. 8 is a partially enlarged view of the mesh 12 after assignment of state is completed. In FIG. 8, what are indicated by circles are differentiated cells 16, and what are indicated by squares are undifferentiated cells 16. On the basis of this state, an iflag is assigned to cells 16. First, "0" is provisionally assigned as an iflag to all the cells 16. Next, the iflags of the differentiated cells 16 are changed. The cell 16 indicated by a reference sign 16*b* in FIG. 8 is adjacent to six cells 16*c*-16*h*. In the present invention, when a triangle with one cell 16 at one vertex thereof has another cell 16 at another vertex thereof, this state is referred to as where "the one cell 16 is adjacent to the other cell 16". The states of the cells 16*c*-16*h* are differentiated. When the states of all the cells 16*c*-16*h* adjacent to the cell 16*b* are differentiated, the iflag of the cell 16*b* is changed from "0" to "1". The cell 16 indicated by a reference sign 16*n* in FIG. 8 is adjacent to six cells 16*h*-16*m*. The states of the cells 16*h*, 16*i*, 16*l*, and 16*m* are differentiated. The states of the cells 16*j* and 16*k* are undifferentiated. When the cell 16*n* is adjacent to one or more cells 16 whose states are undifferentiated, the iflag of the cell 16*n* is changed from "0" to "2". The iflags of all cells 16 whose states are differentiated are changed. The iflags of cells 16 whose states are undifferentiated are not changed. On the basis of the iflags, attributes are assigned to all the cells 16 (STEP 6). The assignment of attribute is performed on the basis of the following rule.

iflag: 0 attribute: OUTSIDE iflag: 1 attribute: INSIDE iflag: 2 attribute: BOUNDARY The mesh 12 in which the assignment of attribute is completed is at first phase. By connecting a plurality of cells 16 whose attributes are BOUNDARY, a first loop 21 is completed. In FIG. 8, the first loop 21 is shown by a thick line.

Figure 9:
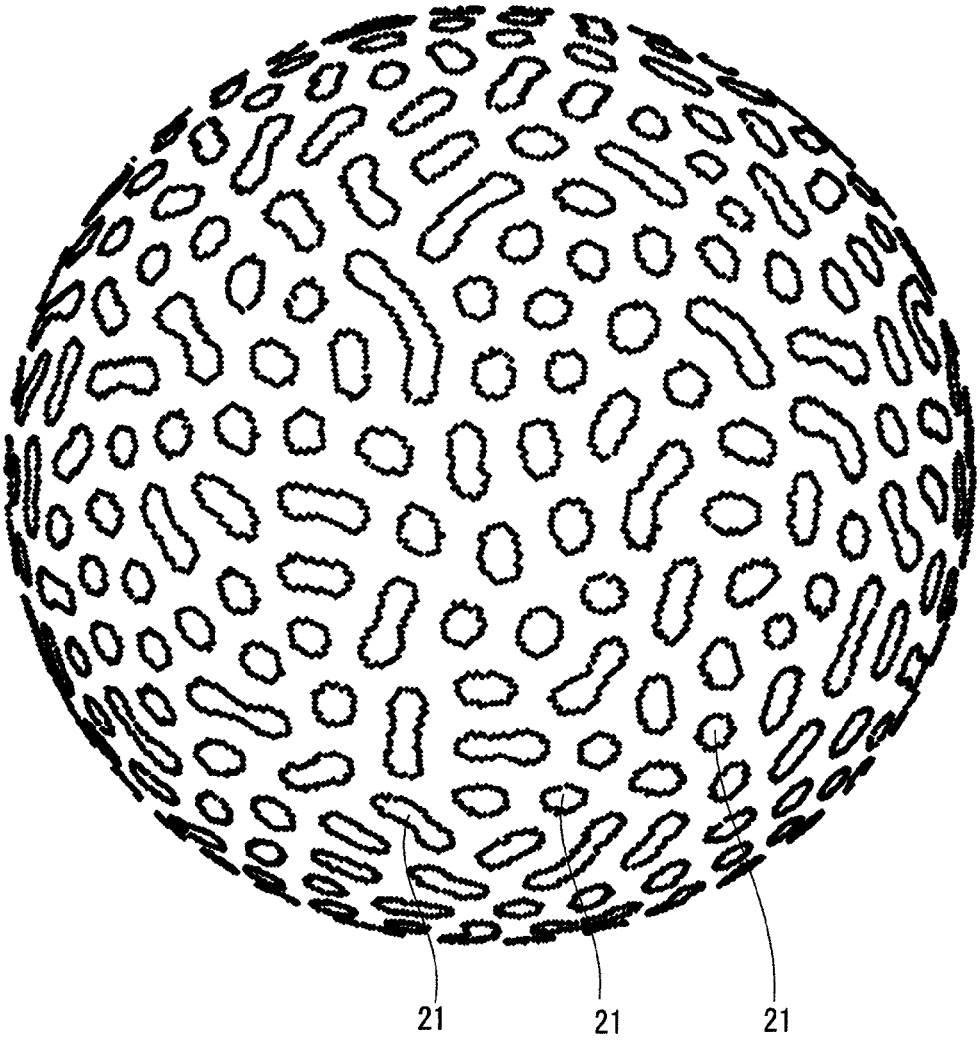
FIG. 9 is a front view of a pattern having first loops.

A pattern having a large number of first loops 21 is shown in FIG. 9. The pattern is obtained by using the following parameters.

W1: 1.0

W2: −0.6

R1: 4.5

R2: 8.0

An occupation ratio of the pattern is calculated (STEP 7). In this calculation, the area surrounded by each first loop 21 is calculated. The areas of all the first loops 21 are summed. The ratio of the sum to the surface area of the phantom sphere 14 is the occupation ratio. The occupation ratio may be approximately calculated by using a large number of triangles shown in FIG. 5. In the approximate calculation, the sum of the areas of triangles included in the first loops 21 is divided by the sum of the areas of all the triangles.

On the basis of the obtained occupation ratio, a determination is performed (STEP 8). At this STEP, it is determined whether or not the occupation ratio is equal to or greater than a predetermined value. In the embodiment shown in FIG. 4, it is determined whether or not an occupation ratio Y is equal to or greater than 65%.

Figure 10:
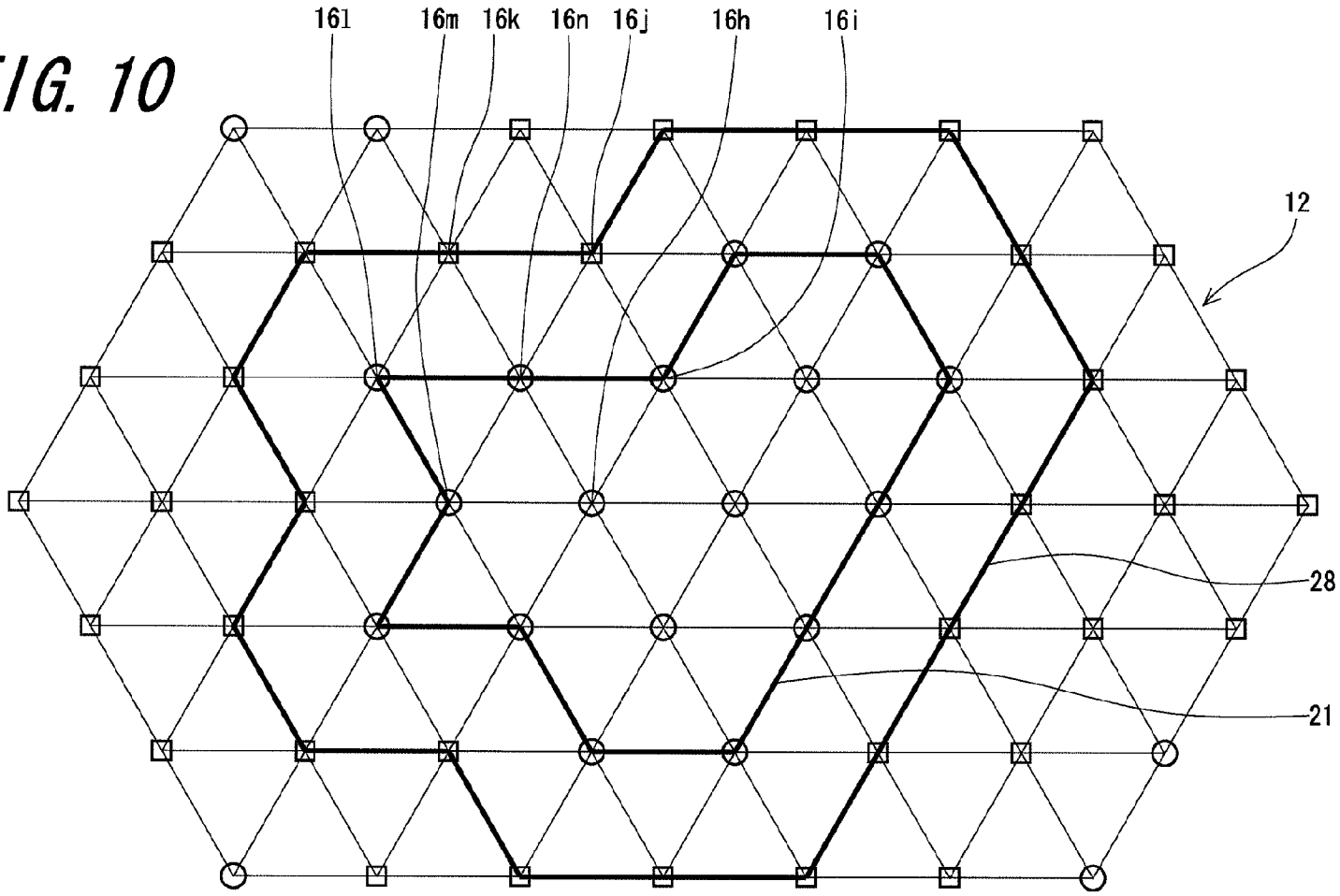
FIG. 10 is a partially enlarged view of the mesh after assignment of attribute is completed.

When the occupation ratio Y is less than 65%, update of attribute is performed (STEP 9). The following will describe a method of this update in detail. FIG. 10 is a partially enlarged view of the mesh 12 after assignment of attribute is completed. The cell 16 indicated by the reference sign 16*n* is present on the first loop 21. The cell 16*n* is adjacent to six cells 16*h* to 16*m*. The iflag of the cell 16*h* is "1" and its attribute is INSIDE. The iflag of a cell 16 whose attribute is INSIDE is not changed. The iflags of the cells 16*i*, 16*l*, and 16*m* are "2", and their attributes are BOUNDARY. The iflag of a cell 16 whose attribute is BOUNDARY and which is adjacent to another cell 16 whose attribute is BOUNDARY is not changed. The iflags of the cells 16*j* and 16*k* are "0", and their attributes are OUTSIDE. The iflag of a cell 16 whose attribute is OUTSIDE and which is adjacent to another cell 16 whose attribute is BOUNDARY is changed from "0" to "3". The iflags of cells 16 adjacent to all the cells 16 present on the first loop 21 are decided. On the basis of the iflags, the update of attribute is performed (STEP 9). The update of attribute is performed on the basis of the following rule.

iflag: 0 attribute: OUTSIDE iflag: 1-2 attribute: INSIDE iflag: 3 attribute: BOUNDARY The mesh 12 in which the update of attribute has been performed once is at second phase.

By connecting a plurality of cells 16 whose attributes are BOUNDARY, a second loop 28 is obtained. The second loop 28 has an area larger than the area of the first loop 21. In other words, the occupation ratio becomes great due to the update of attribute (STEP 9).

Figure 11:
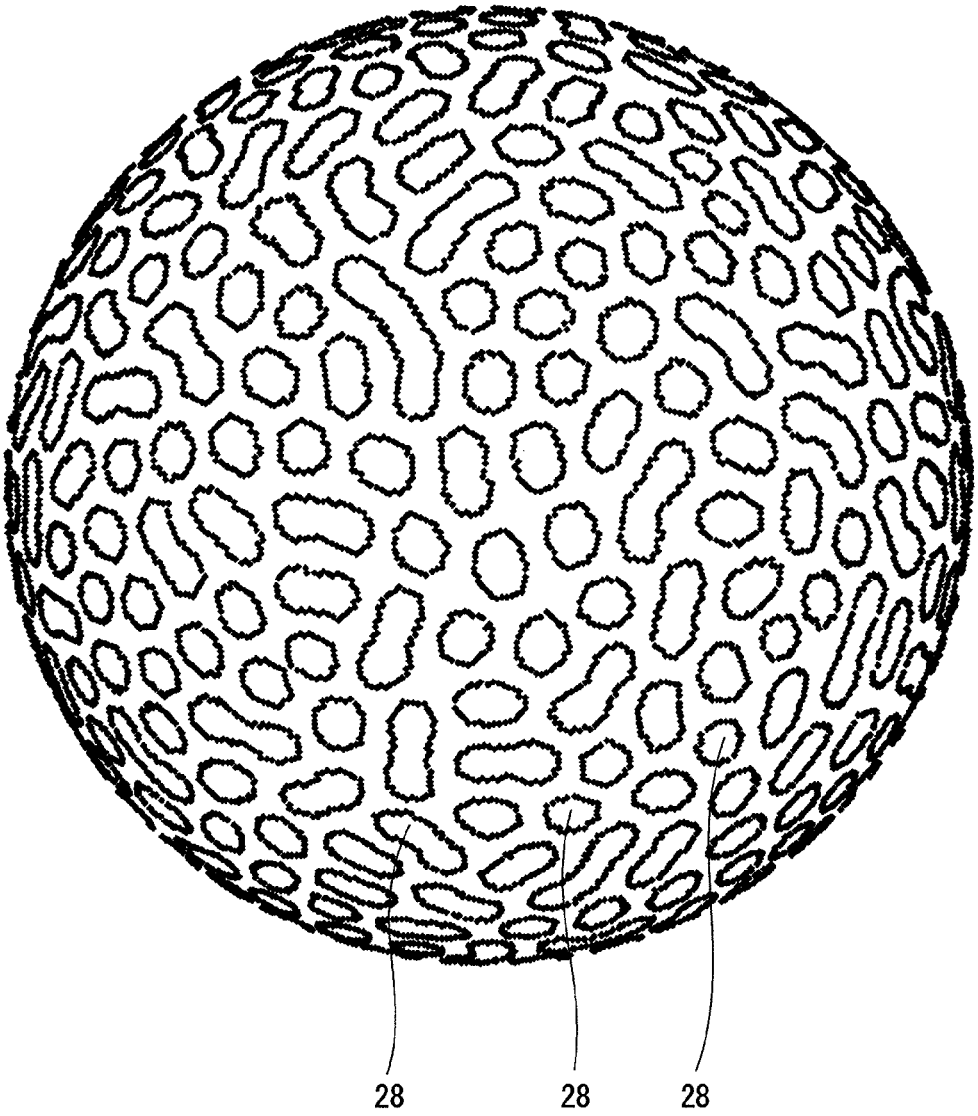
FIG. 11 is a front view of a pattern having second loops.

A pattern having a large number of second loops 28 is shown in FIG. 11. As is obvious from the comparison of FIGS. 9 and 11, the occupation ratio of the pattern in FIG. 11 is greater than that in FIG. 9. The occupation ratio of this pattern is calculated (STEP 7). On the basis of the obtained occupation ratio, the determination is performed (STEP 8). At this STEP, it is determined whether or not the occupation ratio is equal to or greater than the predetermined value. In the embodiment shown in FIG. 4, it is determined whether or not the occupation ratio Y is equal to or greater than 65%. Thereafter, similarly, the update of attribute (STEP 9), the calculation of occupation ratio (STEP 7), and the determination (STEP 8) are repeated until the occupation ratio Y becomes equal to or greater than 65%. Prior to the update of attribute for the Nth time, the iflag of a cell 16 whose attribute is OUTSIDE and which is adjacent to another cell 16 whose attribute is BOUNDARY is changed from "0" to "N+2". The update of attribute for the Nth time is performed on the basis of the following rule.

iflag: 0 attribute: OUTSIDE iflag: 1 to N+1 attribute: INSIDE iflag: N+2 attribute: BOUNDARY The mesh 12 in which the update of attribute has been performed N times is at (N+1)th phase.

Figure 12:
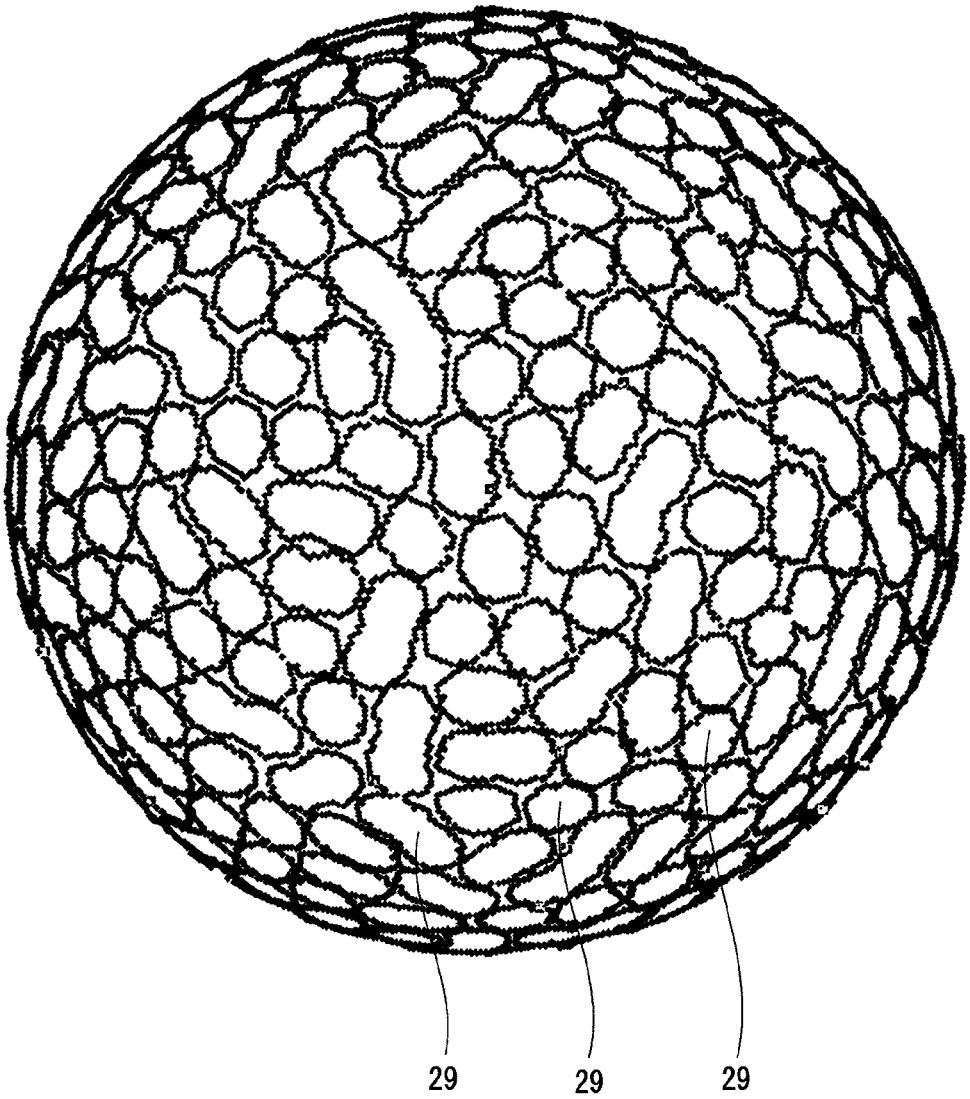
FIG. 12 is a front view of a pattern having third loops.

A pattern obtained by performing the update of attribute twice is shown in FIG. 12. The mesh 12 having this pattern is at third phase. The pattern has a large number of third loops 29. Each third loop 29 has an area equal to or larger than the area of the second loop 28. As is obvious from the comparison of FIGS. 9, 11, and 12, the occupation ratio of the pattern shown in FIG. 12 is great. The occupation ratio of the pattern is 79%.

Figure 13:
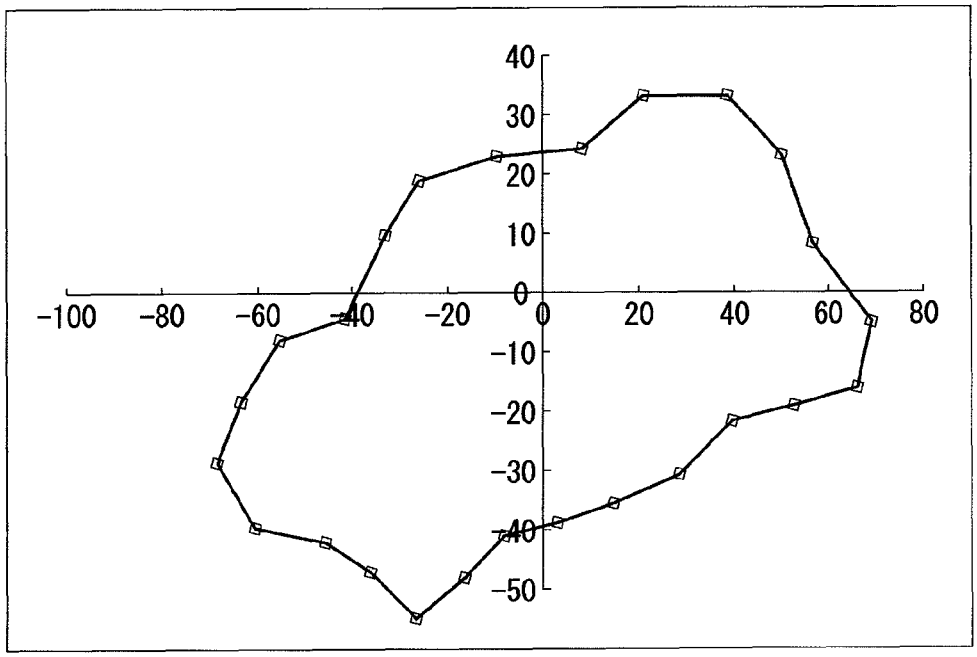
FIG. 13 is a front view of a third loop.

FIG. 13 shows one third loop 29. The third loop 29 is obtained by connecting twenty-five cells 16 whose attributes are BOUNDARY. The third loop 29 has a large number of vertices.

Figure 14:
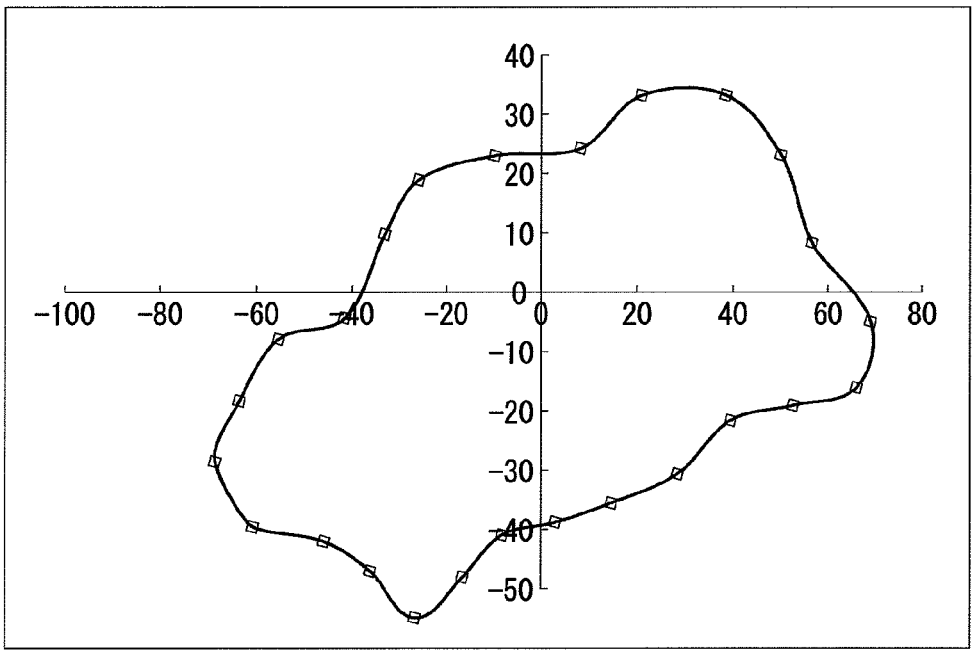
FIG. 14 is a front view of a loop obtained by connecting cells of the third loop in FIG. 13 by a spline curve.

In FIG. 14, the twenty-five cells 16 are connected by a spline curve. The spline curve is a smooth curve that passes through a plurality of points. For the spline curve, a line between adjacent two cells 16 is defined by a polynomial equation. In general, a third-order polynomial equation is used. As is obvious from the comparison of FIGS. 13 and 14, a smooth loop is obtained by using the spline curve.

Preferably, smoothing is performed on coordinates of the cells 16 on the loop, to obtain reference points corresponding to the cells 16 (STEP 10). By connecting a large number of the reference points by a spline curve, a new loop is assumed (STEP 11).

Figure 15:
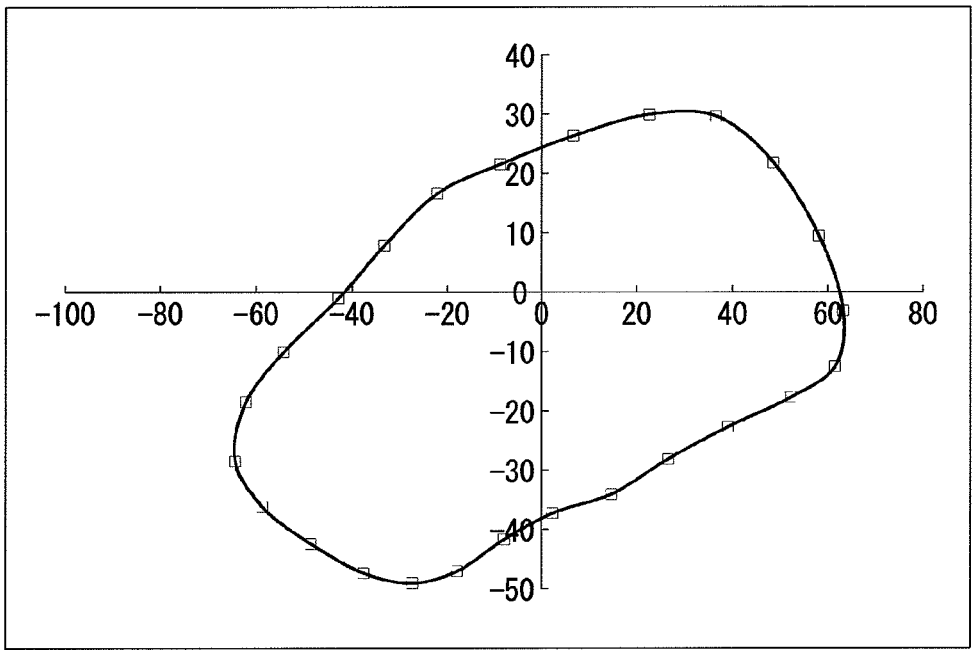
FIG. 15 is a front view of a loop obtained by connecting, by a spline curve, reference points obtained by three-point moving averaging.
Figure 16:
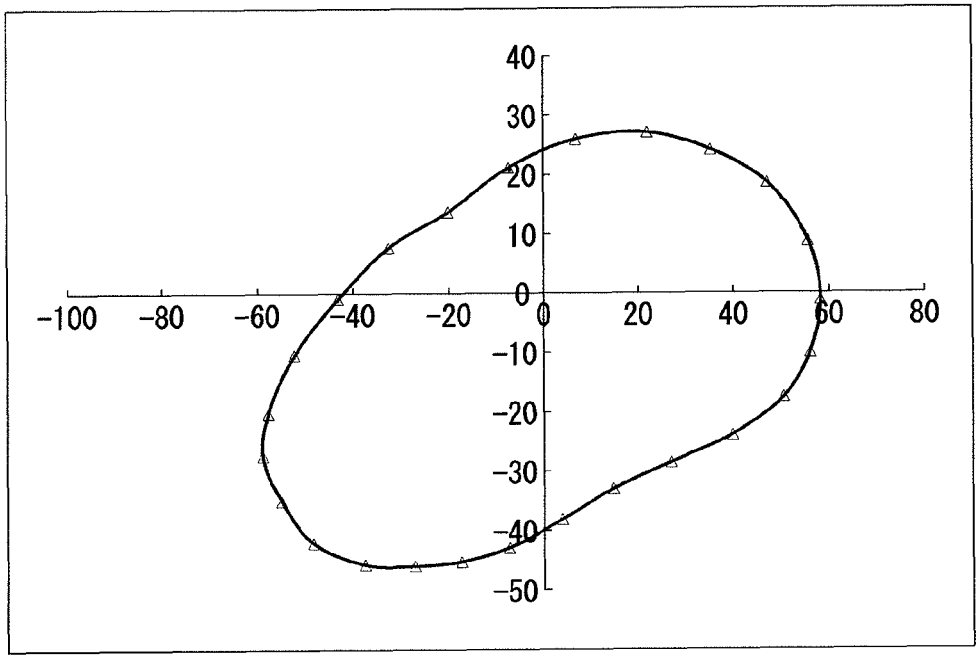
FIG. 16 is a front view of a loop obtained by connecting, by a spline curve, reference points obtained by five-point moving averaging.
Figure 17:
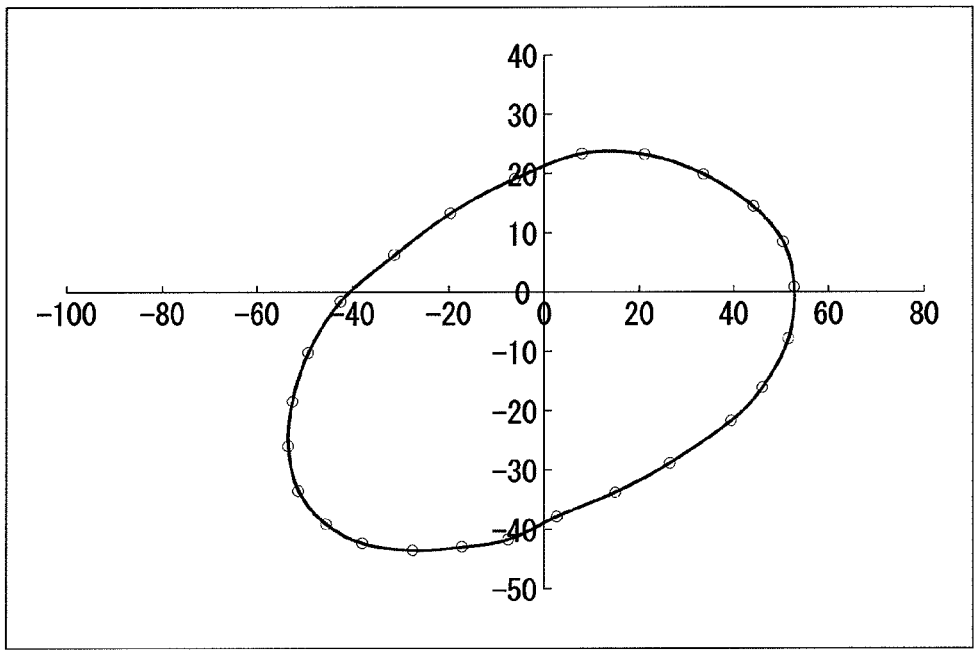
FIG. 17 is a front view of a loop obtained by connecting, by a spline curve, reference points obtained by seven-point moving averaging.

Typical smoothing is moving averaging. FIG. 15 shows a loop obtained by connecting, by a spline curve, reference points obtained by three-point moving averaging. FIG. 16 shows a loop obtained by connecting, by a spline curve, reference points obtained by five-point moving averaging. FIG. 17 shows a loop obtained by connecting, by a spline curve, reference points obtained by seven-point moving averaging. As is obvious from the comparison of FIGS. 14 to 17, smoothing of a contour can be achieved by moving averaging.

In the three-point moving averaging, coordinates of the following three cells 16 are averaged:

(1) a cell 16;

(2) a cell 16 that is closest to the cell 16 in the clockwise direction of the loop; and (3) a cell 16 that is closest to the cell 16 in the counterclockwise direction of the loop.

In the five-point moving averaging, coordinates of the following five cells 16 are averaged:

(1) a cell 16;

(2) a cell 16 that is closest to the cell 16 in the clockwise direction of the loop;

(3) a cell 16 that is closest to the cell 16 in the counterclockwise direction of the loop;

(4) a cell 16 that is second closest to the cell 16 in the clockwise direction of the loop; and (5) a cell 16 that is second closest to the cell 16 in the counterclockwise direction of the loop.

In the seven-point moving averaging, coordinates of the following seven cells 16 are averaged:

(1) a cell 16;

(2) a cell 16 that is closest to the cell 16 in the clockwise direction of the loop;

(3) a cell 16 that is closest to the cell 16 in the counterclockwise direction of the loop;

(4) a cell 16 that is second closest to the cell 16 in the clockwise direction of the loop;

(5) a cell 16 that is second closest to the cell 16 in the counterclockwise direction of the loop;

(6) a cell 16 that is third closest to the cell 16 in the clockwise direction of the loop;

(7) a cell 16 that is third closest to the cell 16 in the counterclockwise direction of the loop.

Figure 18:
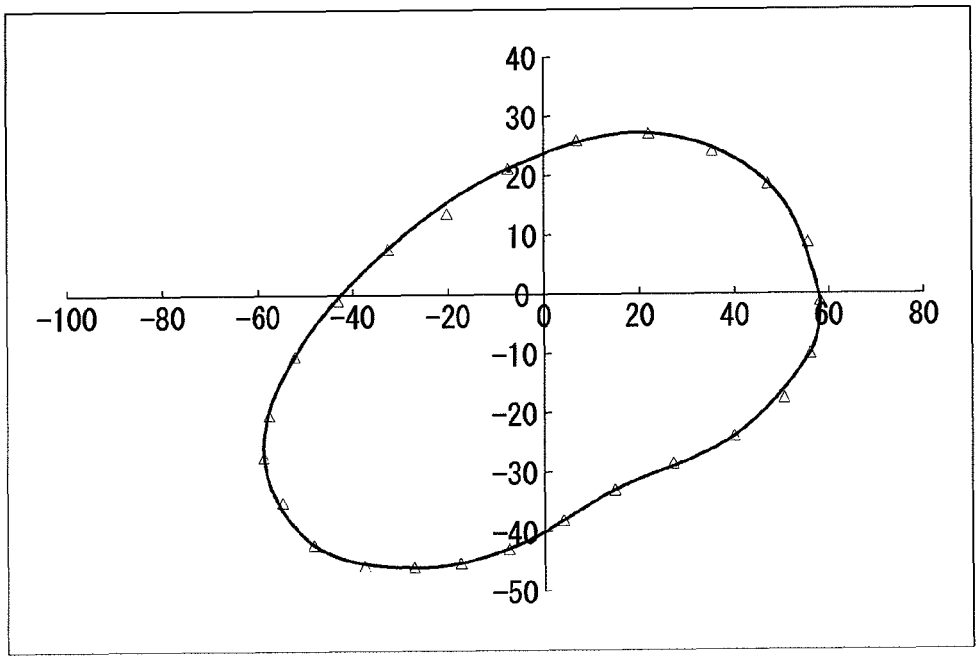
FIG. 18 is a front view of a loop obtained as a result of thinning out the reference points obtained by the five-point moving averaging, into half.
Figure 19:
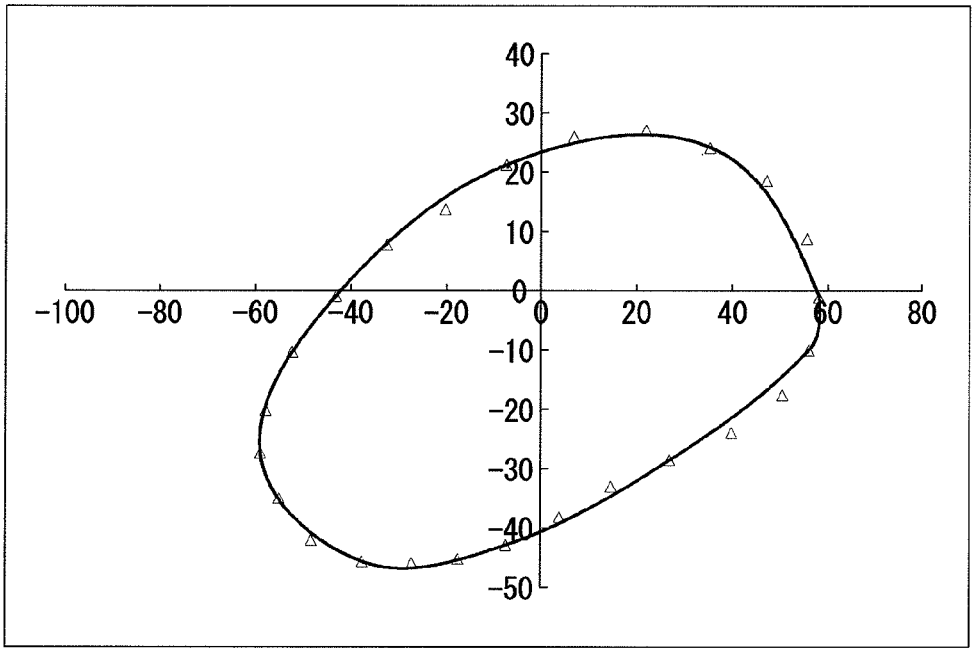
FIG. 19 is a front view of a loop obtained as a result of thinning out the reference points obtained by the five-point moving averaging, into ⅓.
Figure 20:
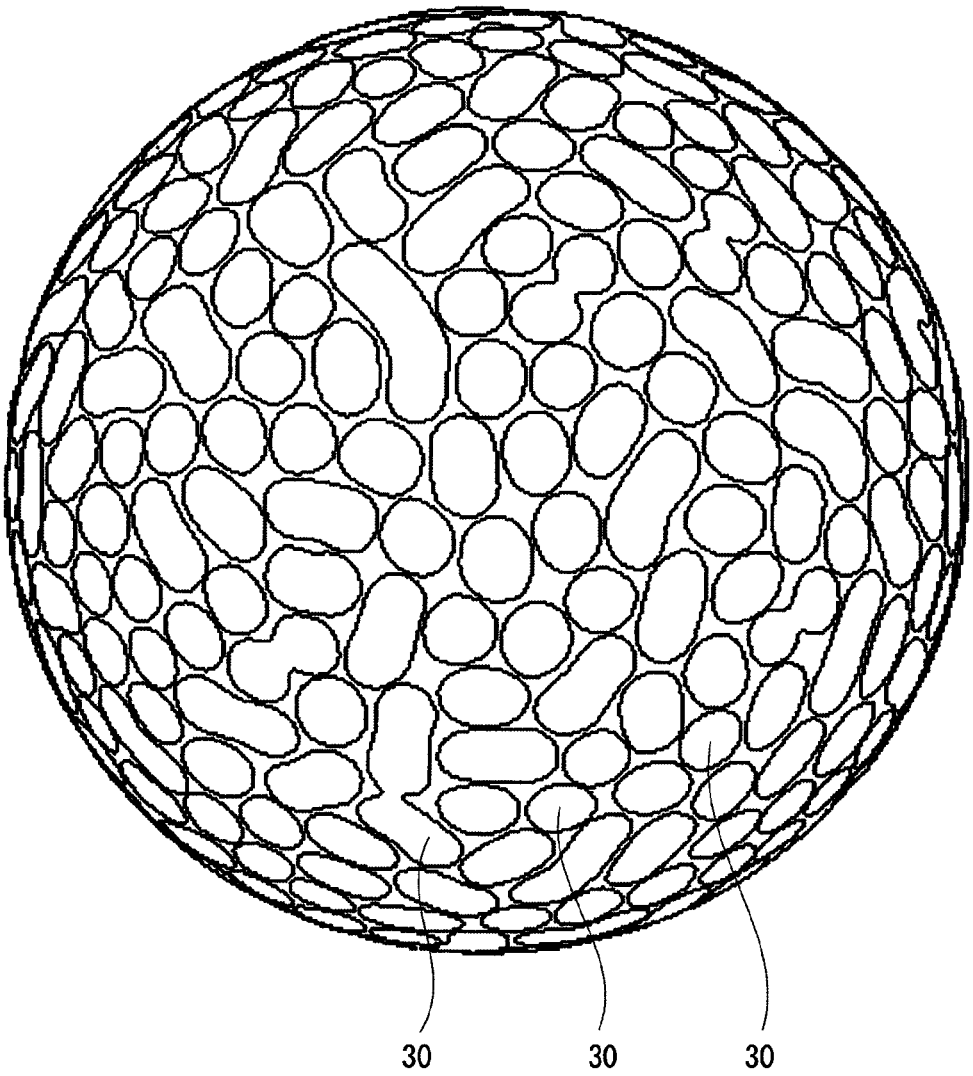
FIG. 20 is a front view of a pattern having the loop in FIG. 19.
Figure 21:
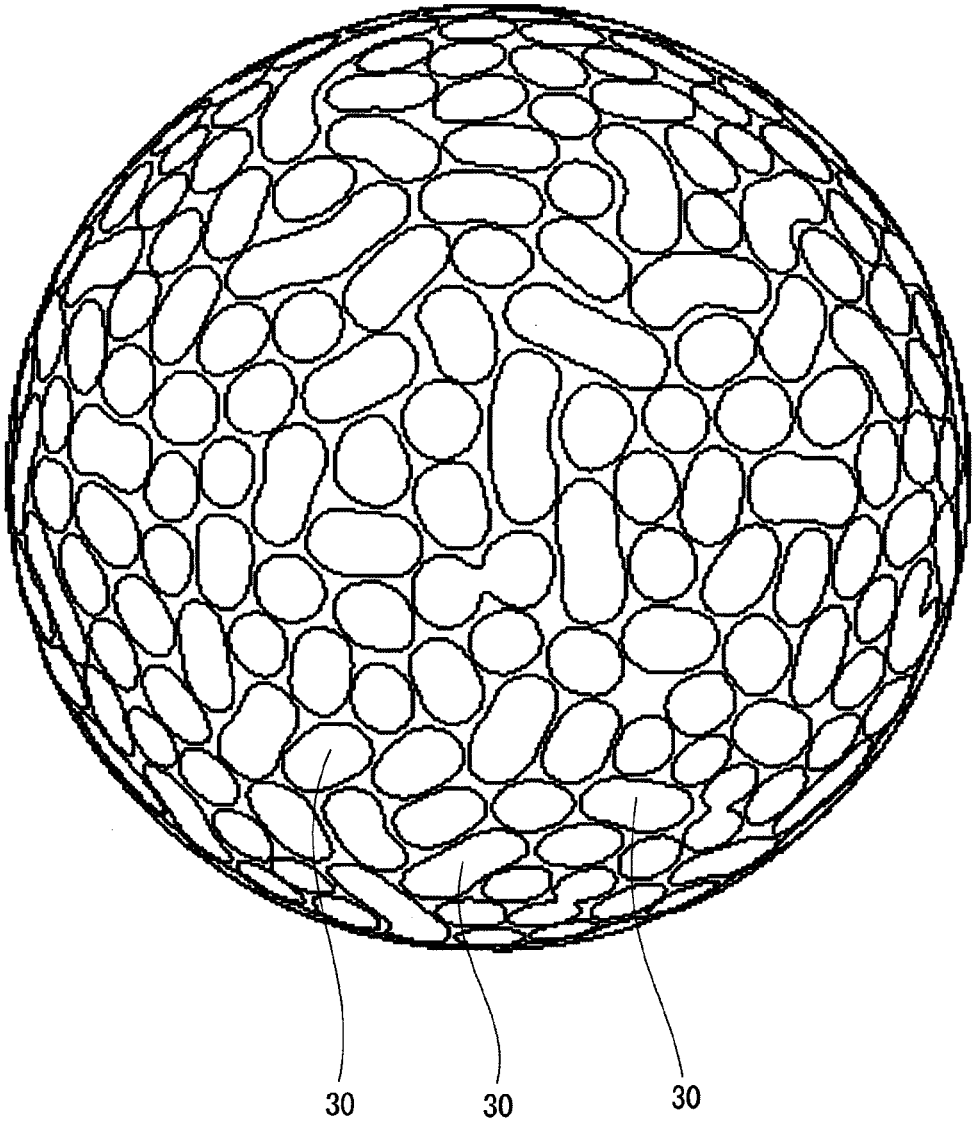
FIG. 21 is a plan view of the pattern in FIG. 20.

When forming a loop, a part of the reference points may be removed, and a spline curve may be drawn. FIG. 18 shows a loop obtained by thinning out the reference points obtained by the five-point moving averaging, into half (one-point skipping). FIG. 19 shows a loop obtained by thinning out the reference points obtained by the five-point moving averaging, into ⅓ (two-point skipping). FIGS. 20 and 21 show a pattern having the loop shown in FIG. 19. The pattern has a large number of loops 30. The loops 30 are randomly arranged on the surface of the phantom sphere 14.

Figure 22:
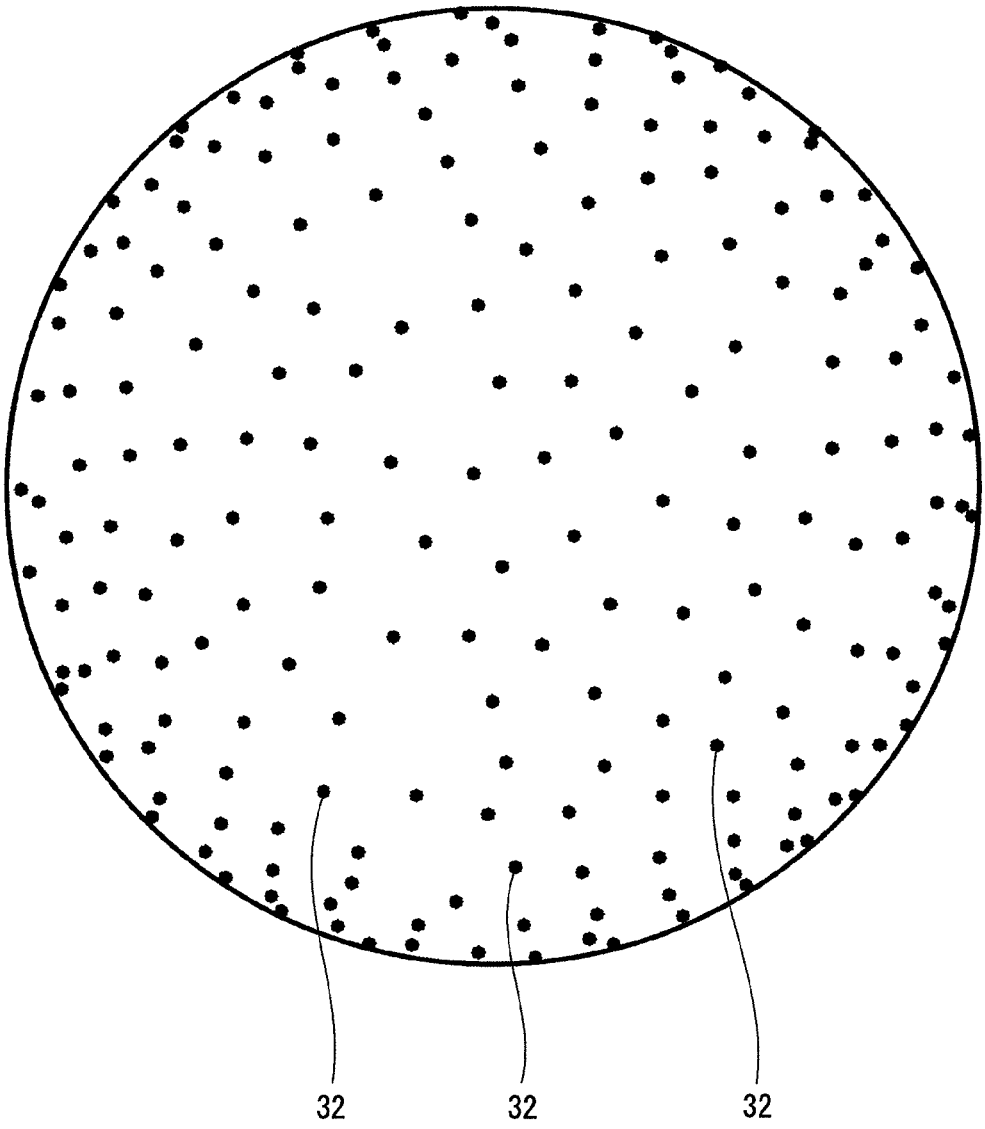
FIG. 22 is a front view showing a large number of points.

The central point of each loop 30 is obtained. A coordinate of the central point is obtained by calculating the average of coordinates of: cells on the contour of the loop 30; and cells present inside the contour. The coordinate of the central point may be obtained by calculating the average of the coordinates of only the cells present inside the contour of the loop 30. The coordinate of the central point may be obtained by calculating the average of the coordinates of only the cells present on the contour of the loop 30. FIG. 22 shows a large number of central points 32. Since the loops 30 are randomly arranged, the central points 32 are also randomly arranged on the surface of the phantom sphere 14.

On the basis of the first loops 21 shown in FIG. 9, points 32 may be decided. In this case as well, a large number of the points 32 arranged randomly are obtained. On the basis of the second loops 28 shown in FIG. 11, points 32 may be decided. In this case as well, a large number of the points 32 arranged randomly are obtained. On the basis of the third loops 29 shown in FIG. 12, points 32 may be decided. In this case as well, a large number of the points 32 arranged randomly are obtained. On the basis of loops obtained by connecting the cells 16 by spline curves (see FIG. 14), points 32 may be decided. In this case as well, a large number of the points 32 arranged randomly are obtained. On the basis of loops obtained by performing the smoothing (see FIGS. 15 to 17), points 32 may be decided. In this case as well, a large number of the points 32 arranged randomly are obtained.

Figure 23:
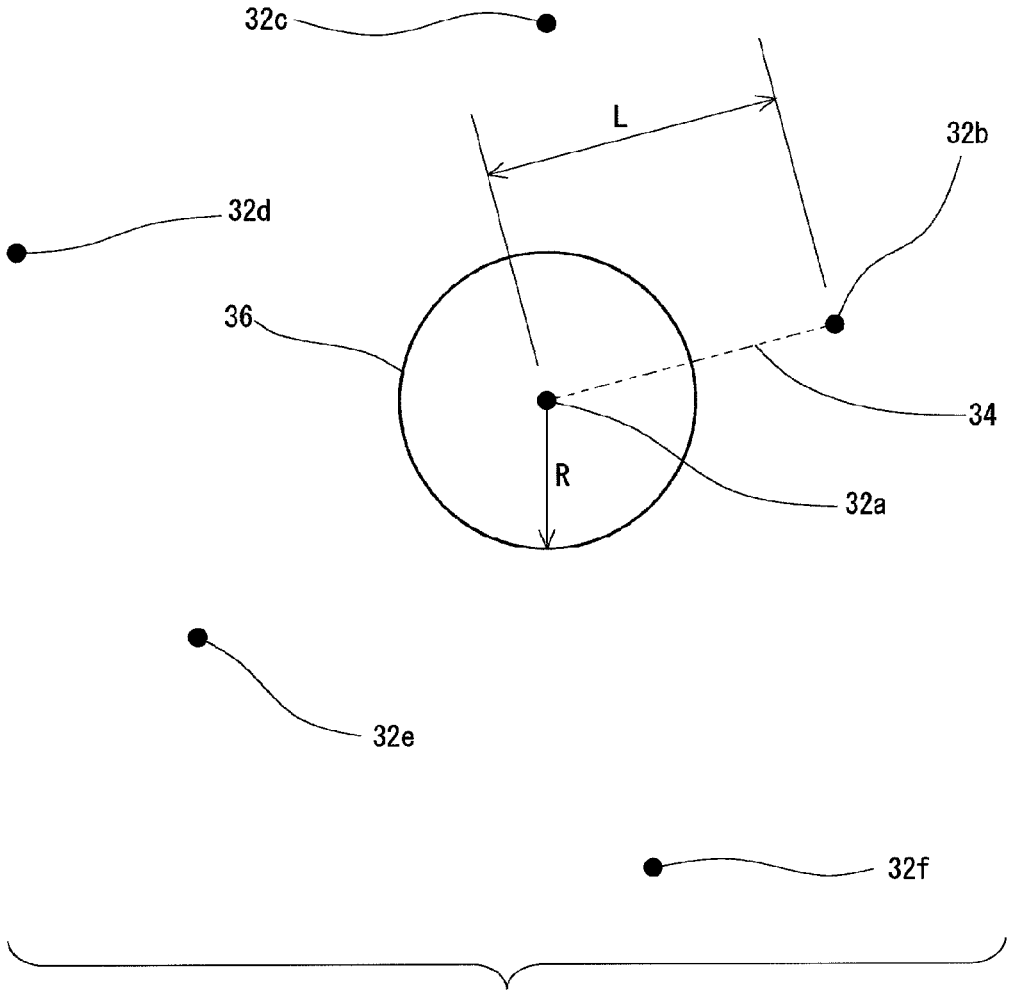
FIG. 23 is an enlarged view showing the points in FIG. 22.

FIG. 23 shows a first point 32*a* and five points (32*b* to 32*f*) adjacent to the first point 32*a*. Among these points 32*b* to 32*f*, the point 32*b* is closest to the first point 32*a*. Hereinafter, the point 32*b* is referred to as second point. In FIG. 23, what is indicated by a reference sign 34 is an imaginary line connecting the first point 32*a* to the second point 32*b*, and what is indicated by an arrow L is the length of the imaginary line 34. The length L is the distance between the first point 32*a* and the second point 32*b*. The first point 32*a* and the second point 32*b* are located on a spherical surface. Thus, the distance L can be calculated as a circular arc length. The distance L may be calculated as a chord length.

In FIG. 23, what is indicated by a reference sign 36 is a circle having a center at the first point 32*a*. The circle has a radius R. The radius R is decided on the basis of the distance L. In the embodiment, the radius R is half of the distance L. A dimple 8 whose contour coincides with the circle is assumed. In other words, the inside of the circle is recessed from the surface of the phantom sphere 14. The cross-sectional shape of the dimple 8 is arbitrary. A dimple 8 whose cross-sectional shape has a single radius may be assumed, or a dimple 8 whose cross-sectional shape has a double radius may be assumed. A dimple 8 having another cross-sectional shape may be assumed.

For each point 32, a circle 36 obtained when this point 32 is set as the first point 32*a* is assumed. Furthermore, for each circle 36, a dimple 8 whose contour coincides with this circle 36 is assumed. In this manner, the dimple pattern shown in FIGS. 2 and 3 is obtained. Since the points 32 are randomly arranged, the dimples 8 are also randomly arranged.

Since the radius R is half of the distance L as described above, the adjacent dimples 8 do not overlap each other. The adjacent dimples 8 are in contact with or spaced apart from each other.

For the purpose of causing the adjacent dimples 8 to overlap each other, the radius R may be larger than half of the distance L. For the purpose of increasing the area of the land 10, the radius R may be smaller than half of the distance L.

In light of suppression of rising of the golf ball 2 during flight, each dimple 8 has a depth of preferably 0.05 mm or greater, more preferably 0.08 mm or greater, and particularly preferably 0.10 mm or greater. In light of suppression of dropping of the golf ball 2 during flight, the depth is preferably equal to or less than 0.60 mm, more preferably equal to or less than 0.45 mm, and particularly preferably equal to or less than 0.40 mm. The depth is the distance between the deepest point of the dimple 8 and the surface of the phantom sphere 14.

In the present invention, the term "volume of dimple" means the volume of the portion surrounded by the surface of the dimple 8 and the plane including the contour of the dimple 8. In light of suppression of rising of the golf ball 2 during flight, the sum of the volumes (total volume) of all the dimples 8 is preferably equal to or greater than 260 $mm^3$ and particularly preferably equal to or greater than 280 $mm^3$. In light of suppression of dropping of the golf ball 2 during flight, the sum is preferably equal to or less than 380 $mm^3$, more preferably equal to or less than 350 $mm^3$, and particularly preferably equal to or less than 320 $mm^3$.

In light of flight performance, the ratio (occupation ratio) of the sum of the areas of the dimples 8 to the surface area of the phantom sphere 14 is preferably equal to or greater than 55% and particularly preferably equal to or greater than 60%.

From the standpoint that a fundamental feature of the golf ball 2 being substantially a sphere is not impaired, the total number of the dimples 8 is preferably equal to or greater than 250 and particularly preferably equal to or greater than 300. From the standpoint that each dimple 8 exerts a sufficient dimple effect, the total number is preferably equal to or less than 450 and particularly preferably equal to or less than 400.

Preferably, the golf ball 2 has a difference dR whose absolute value is equal to or less than 1.0 mm. The absolute value is a parameter that correlates with the aerodynamic symmetry of the golf ball 2. The smaller the absolute value is, the smaller the difference between the trajectory during PH rotation and the trajectory during POP rotation is. The following will describe an evaluation method based on the difference dR.

Figure 24:
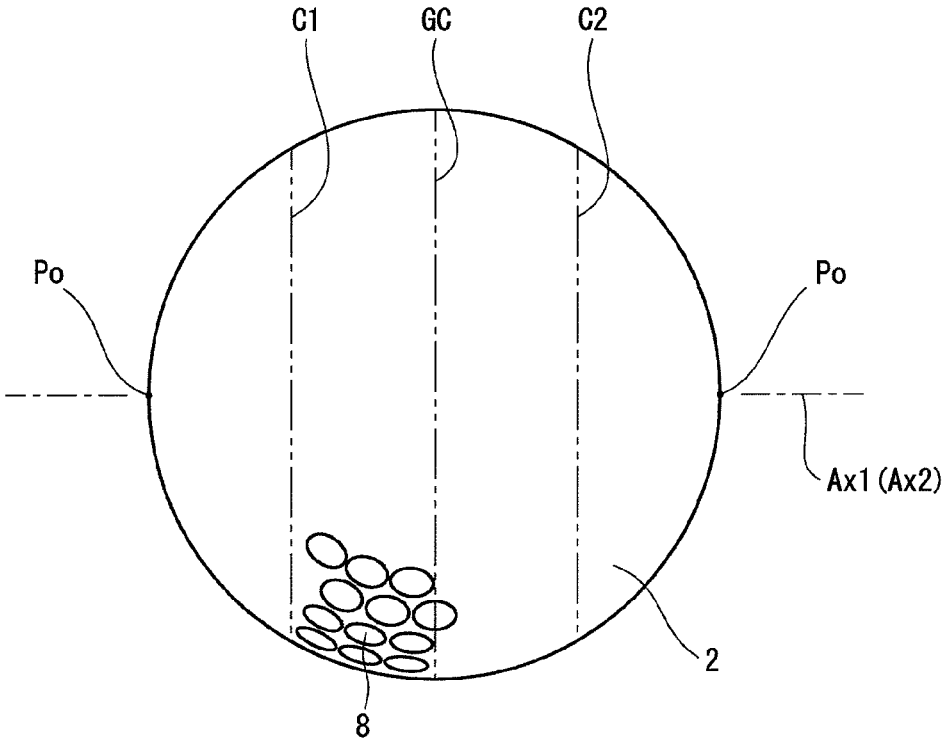
FIG. 24 is a schematic diagram for explaining a method for evaluating the golf ball in FIG. 2.

FIG. 24 is a schematic diagram for explaining the evaluation method. In the evaluation method, a first rotation axis Ax1 is assumed. The first rotation axis Ax1 passes through the two poles Po of the golf ball 2. Each pole Po corresponds to the deepest point of the mold used for forming the golf ball 2. One of the poles Po corresponds to the deepest point of an upper mold half, and the other pole Po corresponds to the deepest point of a lower mold half. The golf ball 2 rotates about the first rotation axis Ax1. This rotation is referred to as PH rotation.

Figure 25:
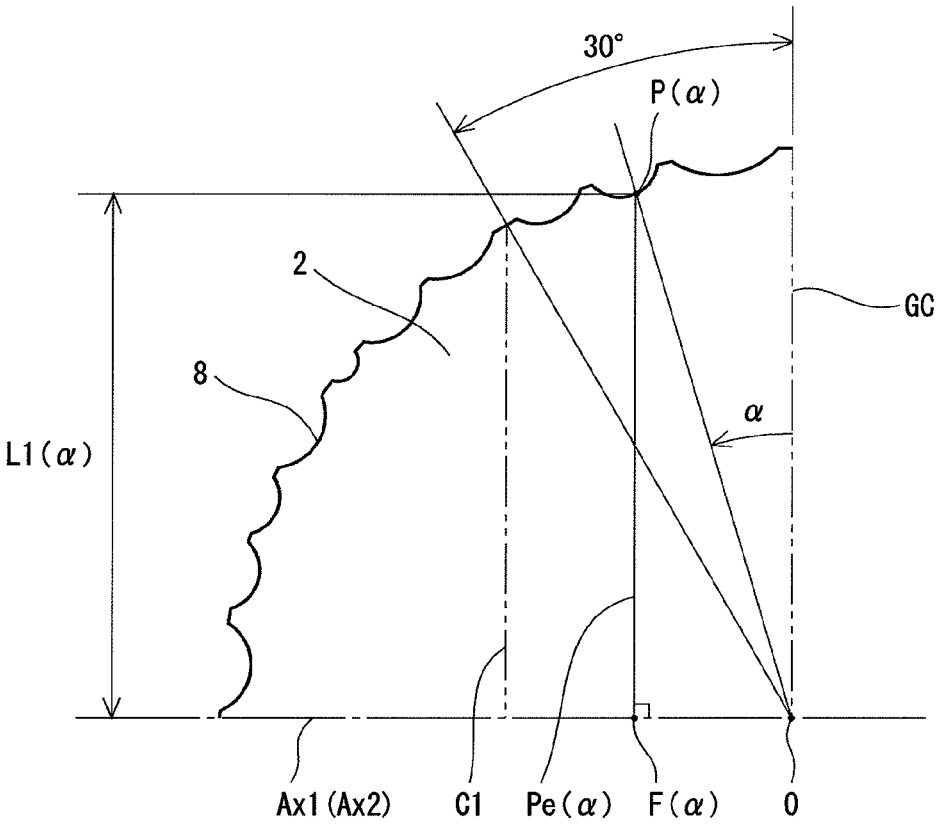
FIG. 25 is a schematic diagram for explaining the method for evaluating the golf ball in FIG. 2.

There is assumed a great circle GC that exists on the surface of the phantom sphere 14 of the golf ball 2 and is orthogonal to the first rotation axis Ax1. The circumferential speed of the great circle GC is faster than any other part of the golf ball 2 during rotation of the golf ball 2. In addition, there are assumed two small circles C1 and C2 that exist on the surface of the phantom sphere 14 of the golf ball 2 and are orthogonal to the first rotation axis Ax1. FIG. 25 schematically shows a partial cross section of the golf ball 2 in FIG. 24. In FIG. 25, the right-to-left direction is the direction of the rotation axis. As shown in FIG. 25, the absolute value of the central angle between the small circle C1 and the great circle GC is 30°. Although not shown in the drawing, the absolute value of the central angle between the small circle C2 and the great circle GC is also 30°. The phantom sphere 14 is divided at the small circles C1 and C2, and of the surface of the golf ball 2, a region sandwiched between the small circles C1 and C2 is defined.

In FIG. 25, a point P(α) is the point which is located on the surface of the golf ball 2 and of which the central angle with the great circle GC is α° (degree). A point F(α) is a foot of a perpendicular line Pe(α) which extends downward from the point P(α) to the first rotation axis Ax1. What is indicated by an arrow L1(α) is the length of the perpendicular line Pe(α). In other words, the length L1(α) is the distance between the point P(α) and the first rotation axis Ax1. For one cross section, the lengths L1(α) are calculated at twenty-one points P(α). Specifically, the lengths L1(α) are calculated at angles α of −30°, −27°, −24°, −21°, −18°, −15°, −12°, −9°, −6°, −3°, 0°, 3°, 6°, 9°, 12°, 15°, 18°, 21°, 24°, 27°, and 30°. The twenty-one lengths L1(α) are summed to obtain a total length L2 (mm). The total length L2 is a parameter dependent on the surface shape in the cross section shown in FIG. 25.

Figure 26:
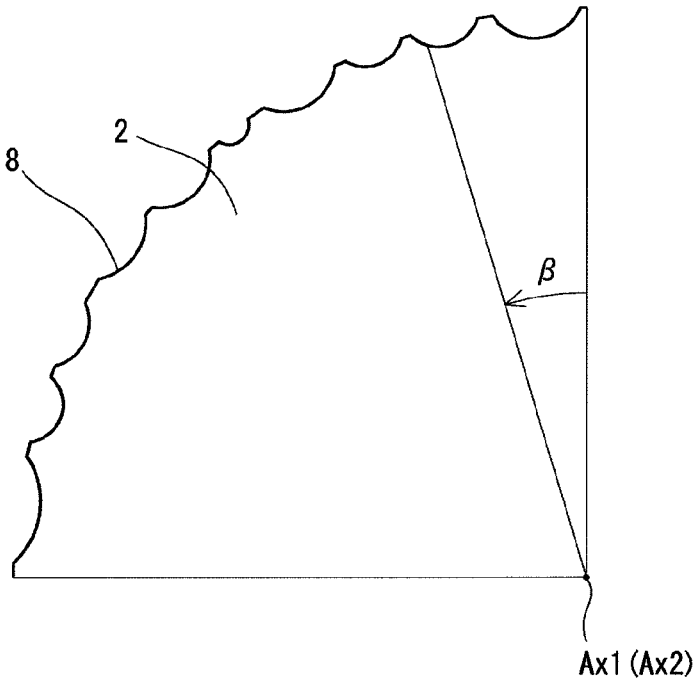
FIG. 26 is a schematic diagram for explaining the method for evaluating the golf ball in FIG. 2.
Figure 28:
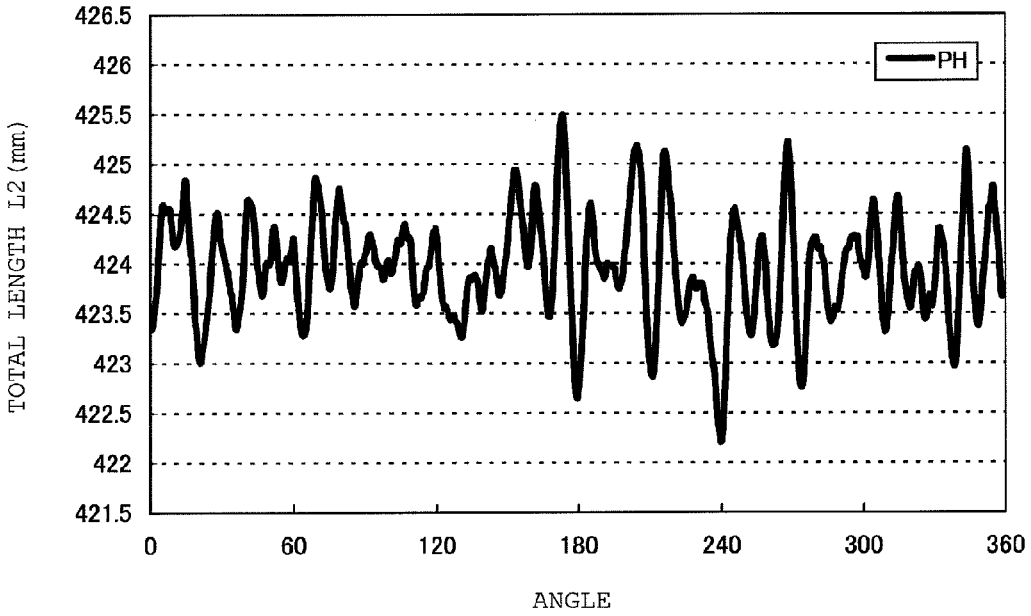
FIG. 28 is a graph showing another evaluation result of the golf ball according to Example 1 of the present invention.

FIG. 26 shows a partial cross section of the golf ball 2. In FIG. 26, the direction perpendicular to the surface of the sheet is the direction of the rotation axis. In FIG. 26, what is indicated by a reference sign β is a rotation angle of the golf ball 2. In a range equal to or greater than 0° and smaller than 360°, the rotation angles β are set at an interval of an angle of 0.25°. At each rotation angle, the total length L2 is calculated. As a result, 1440 total lengths L2 are obtained along the rotation direction. In other words, a data constellation regarding a parameter dependent on a surface shape appearing at a predetermined point moment by moment during one rotation of the golf ball 2, is calculated. The data constellation is calculated on the basis of the 30240 lengths L1. FIG. 28 shows a graph in which a data constellation of the golf ball 2 shown in FIGS. 2 and 3 is plotted. In the graph, the horizontal axis indicates the rotation angle β, and the vertical axis indicates the total length L2. From the graph, the maximum and minimum values of the total lengths L2 are determined. The minimum value is subtracted from the maximum value to calculate a fluctuation range Rh. The fluctuation range Rh is a numeric value indicating an aerodynamic characteristic during PH rotation.

Figure 27:
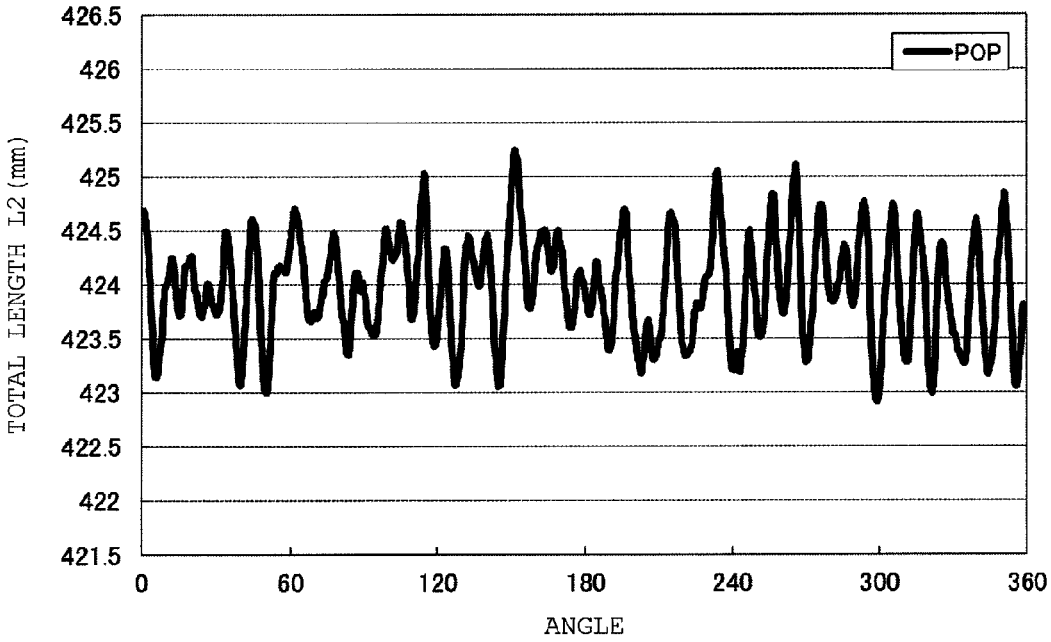
FIG. 27 is a graph showing an evaluation result of a golf ball according to Example 1 of the present invention.

Furthermore, a second rotation axis Ax2 orthogonal to the first rotation axis Ax1 is decided. Rotation of the golf ball 2 about the second rotation axis Ax2 is referred to as POP rotation. Similarly as for PH rotation, for POP rotation, a great circle GC and two small circles C1 and C2 are assumed. The absolute value of the central angle between the small circle C1 and the great circle GC is 30°. The absolute value of the central angle between the small circle C2 and the great circle GC is also 30°. For a region, sandwiched between the small circles C1 and C2, of the surface of the golf ball 2, 1440 total lengths L2 are calculated. In other words, a data constellation regarding a parameter dependent on a surface shape appearing at a predetermined point moment by moment during one rotation of the golf ball 2, is calculated. FIG. 27 shows a graph in which a data constellation of the golf ball 2 shown in FIGS. 2 and 3 is plotted. In the graph, the horizontal axis indicates the rotation angle β, and the vertical axis indicates the total length L2. From the graph, the maximum and minimum values of the total lengths L2 are determined. The minimum value is subtracted from the maximum value to calculate a fluctuation range Ro. The fluctuation range Ro is a numeric value indicating an aerodynamic characteristic during POP rotation.

There are numerous straight lines orthogonal to the first rotation axis Ax1. Thus, there are also numerous great circles GC. A great circle GC, whose part included in the dimples 8 is the longest, is selected, and a fluctuation range Ro and a difference dR are calculated. Instead of this, twenty great circles GC may be extracted in a random manner, and twenty fluctuation ranges may be calculated on the basis of the extracted twenty great circles GC. In this case, the maximum value among twenty pieces of data is set as Ro.

The smaller the fluctuation range Rh is, the larger the flight distance at PH rotation is. The reason is inferred to be that the smaller the fluctuation range Rh is, the more smoothly transition of a turbulent flow continues. In this respect, the fluctuation range Rh is preferably equal to or less than 3.3 mm. The smaller the fluctuation range Ro is, the larger the flight distance at POP rotation is. The reason is inferred to be that the smaller the fluctuation range Ro is, the more smoothly transition of a turbulent flow continues. In this respect, the fluctuation range Ro is preferably equal to or less than 3.3 mm. In light of attainment of a large flight distance at any of PH rotation and POP rotation, both the fluctuation range Rh and the fluctuation range Ro are preferably equal to or less than 3.3 mm.

The fluctuation range Ro is subtracted from the fluctuation range Rh to calculate the difference dR. The difference dR is a parameter indicating the aerodynamic symmetry of the golf ball 2. According to the finding by the inventor of the present invention, the golf ball 2 in which the absolute value of the difference dR is small has excellent aerodynamic symmetry. It is inferred that this is because the similarity between the surface shape during PH rotation and the surface shape during POP rotation is high.

Dimples may be randomly arranged by a method other than the Cellular Automaton method. For example, a person may randomly decide the positions of points on the surface of the phantom sphere, and circles having centers at these points, respectively, may be assumed.

EXAMPLES

A pattern of Example 1 shown in FIGS. 2 and 3 was designed. The pattern has 391 dimples.

Figure 29:
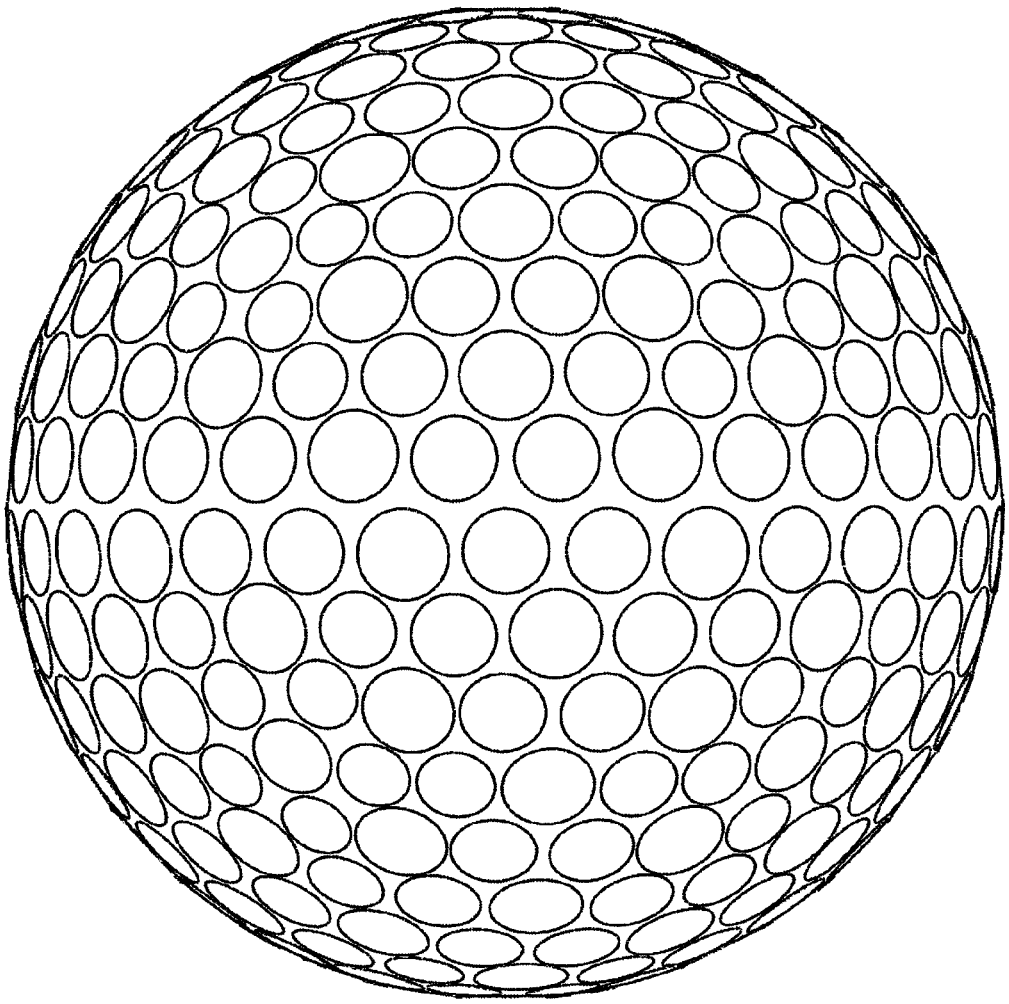
FIG. 29 is a front view of a golf ball according to Comparative Example 1.
Figure 30:
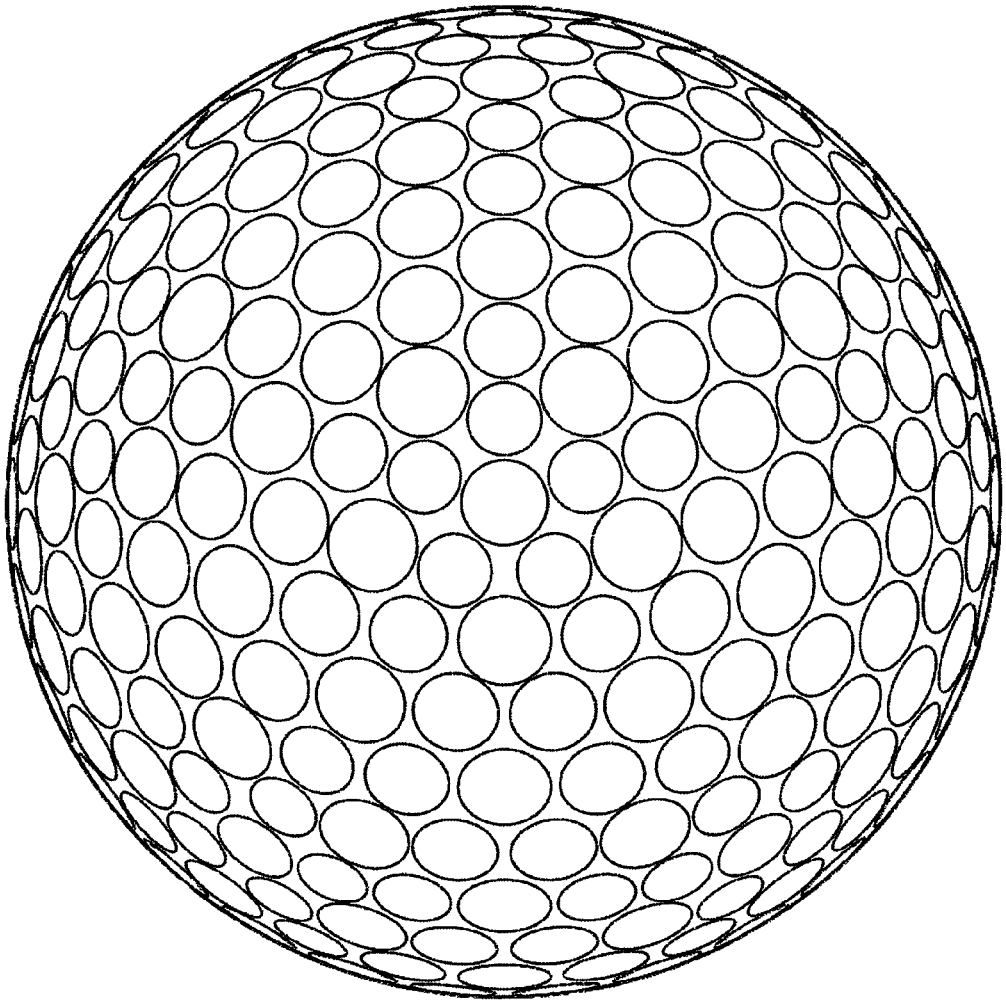
FIG. 30 is a plan view of the golf ball in FIG. 29.

Furthermore, a pattern of Comparative Example 1 shown in FIGS. 29 and 30 was designed. The pattern has dimples A each having a diameter of 4.00 mm, dimples B each having a diameter of 3.70 mm, dimples C each having a diameter of 3.40 mm, and dimples D each having a diameter of 3.20 mm. A cross-sectional shape of each dimple is a circular arc. The details of the dimples are as follows.

| Type | Number | Diameter (mm) | Depth (mm) | Volume ($mm^3$) |
|---|---|---|---|---|
| A | 120 | 4.00 | 0.1532 | 0.964 |
| B | 152 | 3.70 | 0.1532 | 0.825 |
| C | 60 | 3.40 | 0.1532 | 0.697 |
| D | 60 | 3.20 | 0.1532 | 0.618 |

By the aforementioned method, fluctuation ranges Ro and Rh of each pattern were calculated. The results are shown in Table 1 below.

TABLE 1

Results of Evaluation

Figure 31:
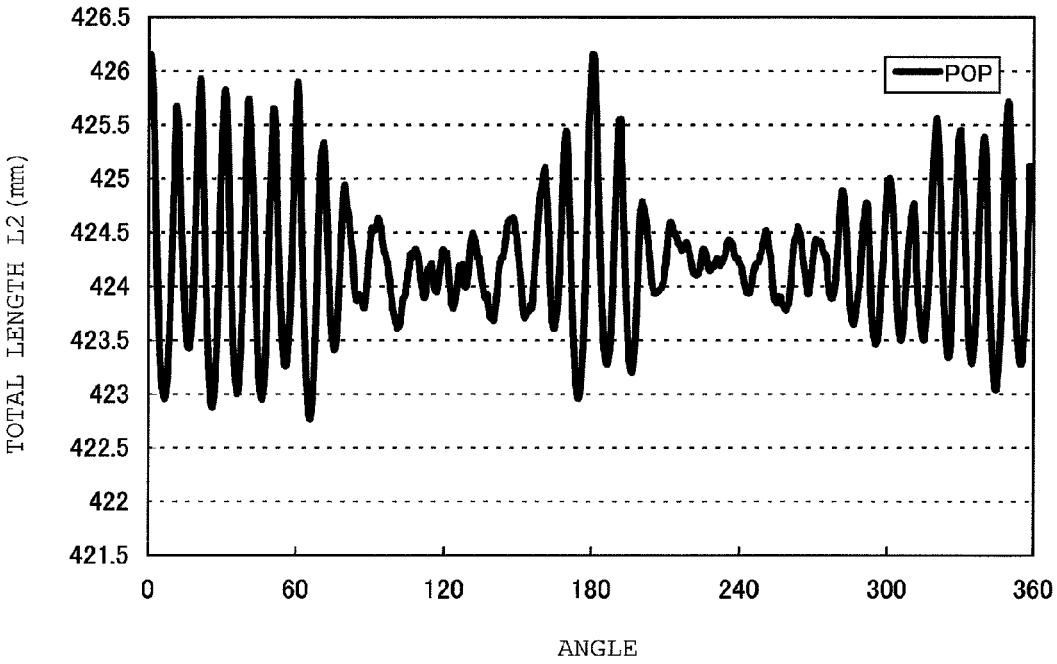
FIG. 31 is a graph showing an evaluation result of the golf ball according to Comparative Example 1.
Figure 32:
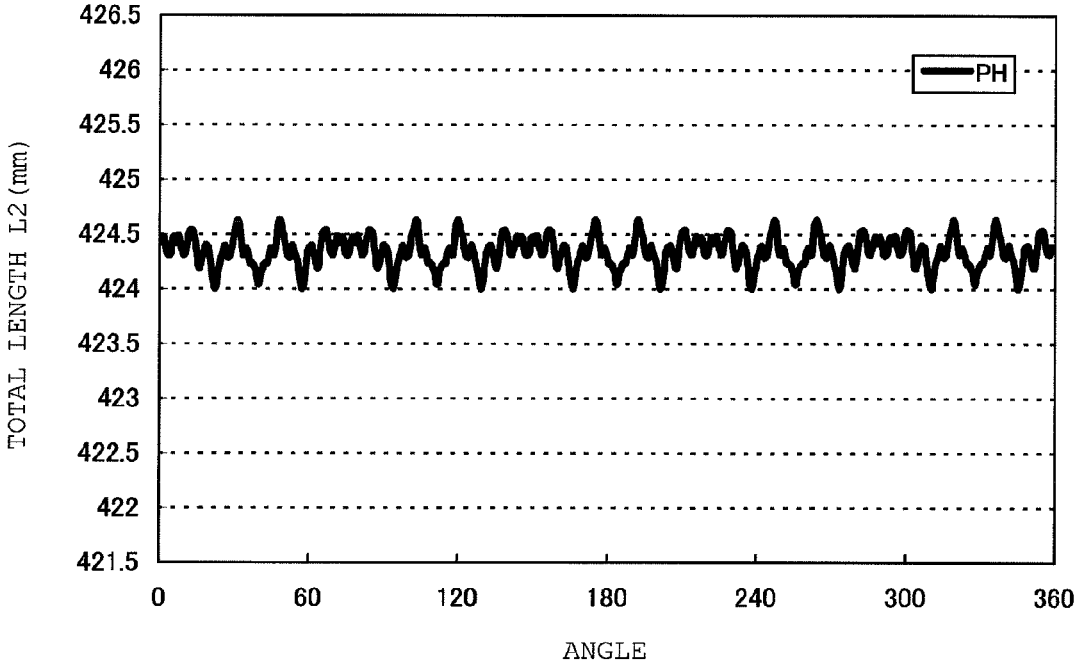
FIG. 32 is a graph showing another evaluation result of the golf ball according to Comparative Example 1.

| | | Example 1 | Comparative Example 1 |
|---|---|---|---|
| Front view | | FIG. 2 | FIG. 29 |
| Plan view | | FIG. 3 | FIG. 30 |
| Occupation ratio (%) | | 62.7 | 73.4 |
| Maximum depth (mm) | | 0.177 | 0.153 |
| Total volume ($mm^3$) | | 320 | 320 |
| POP rotation | Graph | FIG. 27 | FIG. 31 |
| | Ro (mm) | 2.337 | 3.387 |
| PH rotation | Graph | FIG. 28 | FIG. 32 |
| | Rh (mm) | 3.290 | 0.632 |
| dR (mm) | | 0.953 | 2.755 |

As shown in Table 1, dR of the pattern of Example 1 is small. From the results of evaluation, advantages of the present invention are clear.

The dimple pattern described above is applicable to a one-piece golf ball, a multi-piece golf ball, and a thread-wound golf ball, in addition to a two-piece golf ball. The above descriptions are merely for illustrative examples, and various modifications can be made without departing from the principles of the present invention.

What is claimed is:

1. A golf ball having a large number of dimples on a surface thereof, wherein the dimples are randomly arranged, and a pattern of the dimples is designed by a process, the process comprising the steps of:

(1) randomly arranging a large number of points on a surface of a phantom sphere;

(2) calculating a distance between a first point and a second point which is a point closest to the first point;

(3) deciding a radius on the basis of the distance;

(4) assuming a circle which has a center at the first point and has the radius; and (5) assuming a dimple whose contour coincides with the circle, wherein a fluctuation range Rh and a fluctuation range Ro are equal to or less than 3.3 mm, the fluctuation range Rh and the fluctuation range Ro being obtained by the steps of:

(1) assuming a line which connects both poles of the golf ball, as a first rotation axis;

(2) assuming a great circle which exists on a surface of a phantom sphere of the golf ball and is orthogonal to the first rotation axis;

(3) assuming two small circles which exist on the surface of the phantom sphere of the golf ball, which are orthogonal to the first rotation axis, and of which an absolute value of a central angle with the great circle is 30°;

(4) defining a region, of the surface of the golf ball, which is obtained by dividing the golf ball at the two small circles and which is sandwiched between the two small circles;

(5) determining 30240 points on the region at intervals of a central angle of 3° in a direction of the first rotation axis and at intervals of a central angle of 0.25° in a direction of rotation about the first rotation axis;

(6) calculating a length L1 of a perpendicular line which extends from each point to the first rotation axis;

(7) calculating a total length L2 by summing twenty-one lengths L1 calculated on the basis of twenty-one perpendicular lines arranged in the direction of the first rotation axis;

(8) determining a maximum value and a minimum value among 1440 total lengths L2 calculated along the direction of rotation about the first rotation axis, and calculating a fluctuation range Rh by subtracting the minimum value from the maximum value;

(9) assuming a second rotation axis orthogonal to the first rotation axis assumed at the step (1);

(10) assuming a great circle which exists on the surface of the phantom sphere of the golf ball and is orthogonal to the second rotation axis;

(11) assuming two small circles which exist on the surface of the phantom sphere of the golf ball, which are orthogonal to the second rotation axis, and of which an absolute value of a central angle with the great circle is 30°;

(12) defining a region, of the surface of the golf ball, which is obtained by dividing the golf ball at the two small circles and which is sandwiched between the two small circles;

(13) determining 30240 points on the region at intervals of a central angle of 3° in a direction of the second rotation axis and at intervals of a central angle of 0.25° in a direction of rotation about the second rotation axis;

(14) calculating a length L1 of a perpendicular line which extends from each point to the second rotation axis;

(15) calculating a total length L2 by summing twenty-one lengths L1 calculated on the basis of twenty-one perpendicular lines arranged in the direction of the second rotation axis; and

(16) determining a maximum value and a minimum value among 1440 total lengths L2 calculated along the direction of rotation about the second rotation axis, and calculating a fluctuation range Ro by subtracting the minimum value from the maximum value, wherein an absolute value of a difference dR between the fluctuation range Rh and the fluctuation range Ro is equal to or less than 1.0 mm.

* * * * *